US007856306B2

(12) United States Patent
Nomura et al.

(10) Patent No.: US 7,856,306 B2
(45) Date of Patent: Dec. 21, 2010

(54) VEHICLE-MOUNTED ENGINE CONTROL APPARATUS

(75) Inventors: Masahiko Nomura, Tokyo (JP); Koji Hashimoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 12/555,499

(22) Filed: Sep. 8, 2009

(65) Prior Publication Data

US 2010/0206280 A1 Aug. 19, 2010

(30) Foreign Application Priority Data

Feb. 13, 2009 (JP) ..... 2009-031676

(51) Int. Cl.
*F02D 41/26* (2006.01)

(52) U.S. Cl. ..... 701/109; 701/103; 123/697; 73/114.72

(58) Field of Classification Search ..... 701/103–105, 701/109; 123/672, 676, 697; 73/114.69, 73/114.71, 114.72, 114.73
See application file for complete search history.

(56) References Cited

U.S. PATENT DOCUMENTS 5,833,836 A * 11/1998 Takami et al. ..... 205/785
6,067,841 A * 5/2000 Suzuki et al. ..... 73/23.32
6,533,921 B2 * 3/2003 Miyata et al. ..... 205/781
6,712,054 B2 * 3/2004 Hosoya et al. ..... 123/697
7,017,567 B2 * 3/2006 Hosoya et al. ..... 123/697
7,449,092 B2 * 11/2008 Kerns et al. ..... 204/425
7,462,266 B2 * 12/2008 Miyata et al. ..... 204/408
2010/0114453 A1 * 5/2010 Anilovich et al. ..... 701/102

FOREIGN PATENT DOCUMENTS

JP 11-281617 A 10/1999
JP 2002-256935 A 9/2002

* cited by examiner

*Primary Examiner*—Hai H Huynh
(74) *Attorney, Agent, or Firm*—Sughrue Mion, PLLC

(57) ABSTRACT

A vehicle-mounted engine control apparatus can accurately measure the resistance value of a label resistor arranged in an exhaust gas sensor for correcting characteristic variation thereof by using a reduced number of wires. An electric heater of the exhaust gas sensor, which is powered from a second power supply wire, as well as the label resistor and air fuel ratio measurement elements are connected to the apparatus which is powered from an on-vehicle battery through a first power supply wire. A power feed voltage of the apparatus is input to a multichannel AD converter through voltage dividing resistors, so that a positive end potential of the label resistor is measured alternatively. A negative end potential of the label resistor is input to the converter as a divided voltage thereof with a fixed resistor. The label resistance value is calculated from a fixed resistor current and a label resistor voltage.

14 Claims, 11 Drawing Sheets

200 : STANDARD OUTPUT CHARACTERISTIC
201 : LOWER LIMIT OUTPUT CHARACTERISTIC
202 : UPPER LIMIT OUTPUT CHARACTERISTIC

FIG.4

IN CASE OF R0=1.0KΩ, R1=2.2KΩ, $\gamma$=1.2

| LABEL ORDER i | LABEL RESISTOR Rx | | | | SENSOR OUTPUT CORRECTION FACTOR K |
|---|---|---|---|---|---|
| | Rmin | REFERENCE VALUE Ri | | Rmax | |
| 0 | LESS THAN 2.0(SHORT-CIRCUIT ABNORMALITY) | | | | 1 OR REMAIN UNCHANGED |
| 1 | ≧2.0 | 2.2 | ±2% | <2.4 | 0.800 |
| 2 | ≧2.4 | 3.0 | ±2% | <3.3 | 0.820 |
| 3 | ≧3.3 | 3.9 | ±2% | <4.3 | 0.840 |
| 4 | ≧4.3 | 5.1 | ±2% | <5.6 | 0.860 |
| 5 | ≧5.6 | 6.8 | ±2% | <7 | 0.880 |
| 6 | ≧7 | 9.1 | ±2% | <10 | 0.900 |
| 7 | ≧10 | 12 | ±2% | <13 | 0.920 |
| 8 | ≧13 | 15 | ±2% | <16 | 0.940 |
| 9 | ≧16 | 18 | ±2% | <19 | 0.960 |
| 10 | ≧19 | 22 | ±2% | <24 | 0.980 |
| 11 | ≧24 | 27 | ±2% | <29 | 1.000 |
| 12 | ≧29 | 33 | ±2% | <36 | 1.020 |
| 13 | ≧36 | 43 | ±2% | <47 | 1.040 |
| 14 | ≧47 | 56 | ±2% | <62 | 1.060 |
| 15 | ≧62 | 68 | ±2% | <75 | 1.080 |
| 16 | ≧75 | 82 | ±2% | <90 | 1.100 |
| 17 | ≧90 | 100 | ±2% | <110 | 1.120 |
| 18 | ≧110 | 120 | ±2% | <132 | 1.140 |
| 19 | ≧132 | 150 | ±2% | <165 | 1.160 |
| 20 | ≧165 | 180 | ±2% | <198 | 1.180 |
| 21 | ≧198 | 220 | ±2% | <242 | 1.200 |
| 22 | ≧242 (OPEN-CIRCUIT ABNORMALLITY) | | | | 1 OR REMAIN UNCHANGED |

REFERENCE VALUES OF E24 SERIES ARE, (10,11,12,13,15,16,18,20,22,24,27,30,33,36,39,43,47,51,56,62,68,75,82,91) × 10^n

FIG.6

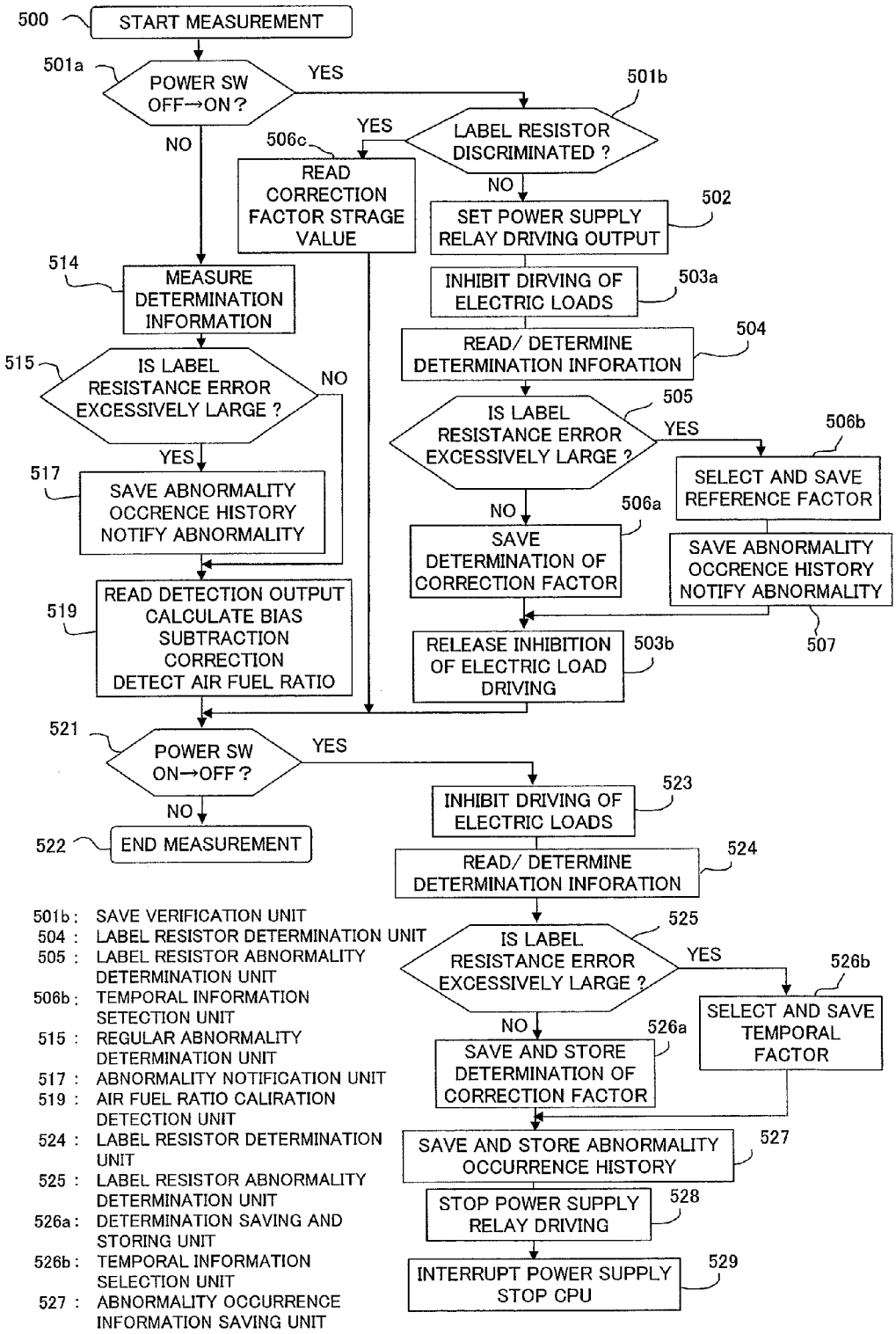

501b : SAVE VERIFICATION UNIT
504 : LABEL RESISTOR DETERMINATION UNIT
505 : LABEL RESISTOR ABNORMALITY DETERMINATION UNIT
506b : TEMPORAL INFORMATION SETECTION UNIT
515 : REGULAR ABNORMALITY DETERMINATION UNIT
517 : ABNORMALITY NOTIFICATION UNIT
519 : AIR FUEL RATIO CALIRATION DETECTION UNIT
524 : LABEL RESISTOR DETERMINATION UNIT
525 : LABEL RESISTOR ABNORMALITY DETERMINATION UNIT
526a : DETERMINATION SAVING AND STORING UNIT
526b : TEMPORAL INFORMATION SELECTION UNIT
527 : ABNORMALITY OCCURRENCE INFORMATION SAVING UNIT

602a : POSITIVE TERMINAL POTENTIAL MEASUREMENT UNIT
602b : POSITIVE TERMINAL POTENTIAL VERIFICATION UNIT
604a : NEGATIVE TERMINAL POTENTIAL MEASUREMENT UNIT

FIG.9

IN CASE OF R0=100KΩ, R1=1.1KΩ, Von=0.5V, Vcc=5V, $\gamma$=1.1

| LABEL ORDER i | LABEL RESISTOR Rx | | | | SENSOR OUTPUT CORRECTION FACTOR K |
|---|---|---|---|---|---|
| | Rmin | REFERENCE VALUE Ri | | Rmax | |
| 0 | LESS THAN 1.04 (SHORT-CIRCUIT ABNORMALITY) | | | | 1 OR REMAIN UNCHANGED |
| 1 | ≧1.04 | 1.1 | ±2% | <1.16 | 0.800 |
| 2 | ≧1.16 | 2.4 | ±2% | <2.52 | 0.820 |
| 3 | ≧2.52 | 3.9 | ±2% | <4.10 | 0.840 |
| 4 | ≧4.10 | 5.6 | ±2% | <5.88 | 0.860 |
| 5 | ≧5.88 | 7.5 | ±2% | <7.88 | 0.880 |
| 6 | ≧7.88 | 10.0 | ±2% | <10.5 | 0.900 |
| 7 | ≧10.5 | 13.0 | ±2% | <13.7 | 0.920 |
| 8 | ≧13.7 | 16.0 | ±2% | <16.8 | 0.940 |
| 9 | ≧16.8 | 20.0 | ±2% | <21.0 | 0.960 |
| 10 | ≧21.0 | 24.0 | ±2% | <25.2 | 0.980 |
| 11 | ≧25.2 | 30.0 | ±2% | <31.5 | 1.000 |
| 12 | ≧31.5 | 36.0 | ±2% | <37.8 | 1.020 |
| 13 | ≧37.8 | 43.0 | ±2% | <45.2 | 1.040 |
| 14 | ≧45.2 | 56.0 | ±2% | <58.8 | 1.060 |
| 15 | ≧58.8 | 68.0 | ±2% | <71.4 | 1.080 |
| 16 | ≧71.4 | 91.0 | ±2% | <95.6 | 1.100 |
| 17 | ≧95.6 | 120.0 | ±2% | <126 | 1.120 |
| 18 | ≧126 | 160.0 | ±2% | <168 | 1.140 |
| 19 | ≧168 | 220.0 | ±2% | <231 | 1.160 |
| 20 | ≧231 | 330.0 | ±2% | <347 | 1.180 |
| 21 | ≧347 | 620.0 | ±2% | <651 | 1.200 |
| 22 | ≧651 (OPEN-CIRCUIT ABNORMALLITY) | | | | 1 OR REMAIN UNCHANGED |

REFERENCE VALUES OF E24 SERIES ARE, (10,11,12,13,15,16,18,20,22,24,27,30,33,36,39,43,47,51,56,62,68,75,82,91) × 10^n

FIG.10

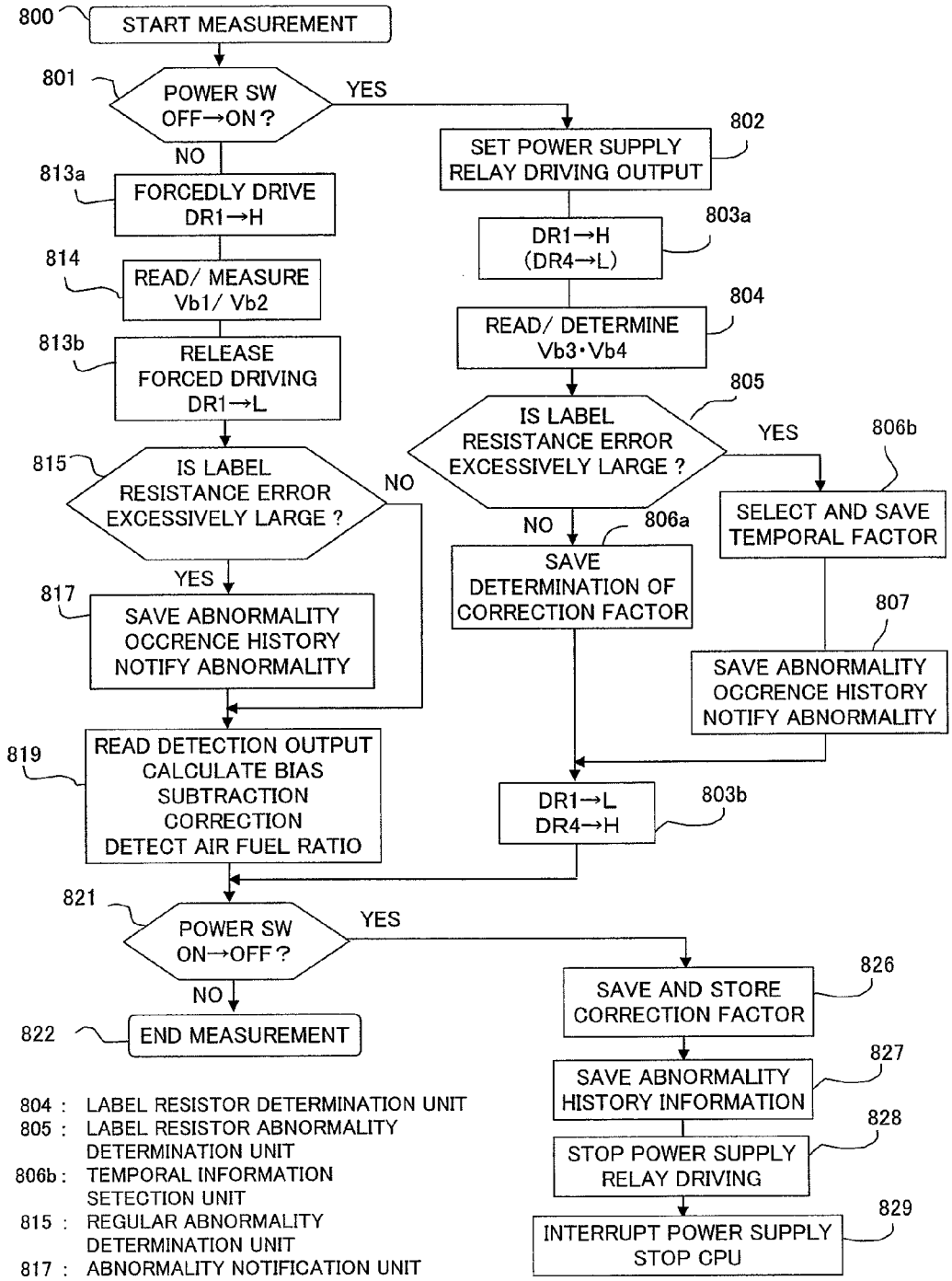

804 : LABEL RESISTOR DETERMINATION UNIT
805 : LABEL RESISTOR ABNORMALITY DETERMINATION UNIT
806b : TEMPORAL INFORMATION SETECTION UNIT
815 : REGULAR ABNORMALITY DETERMINATION UNIT
817 : ABNORMALITY NOTIFICATION UNIT
819 : AIR FUEL RATIO CALIRATION DETECTION UNIT
826 : DETERMINATION SAVING AND STORING UNIT
827 : ABNORMALITY OCCURRENCE INFORMATION SAVING UNIT
319 : AIR FUEL RATIO CALIRATION DETECTION UNIT

FIG.11

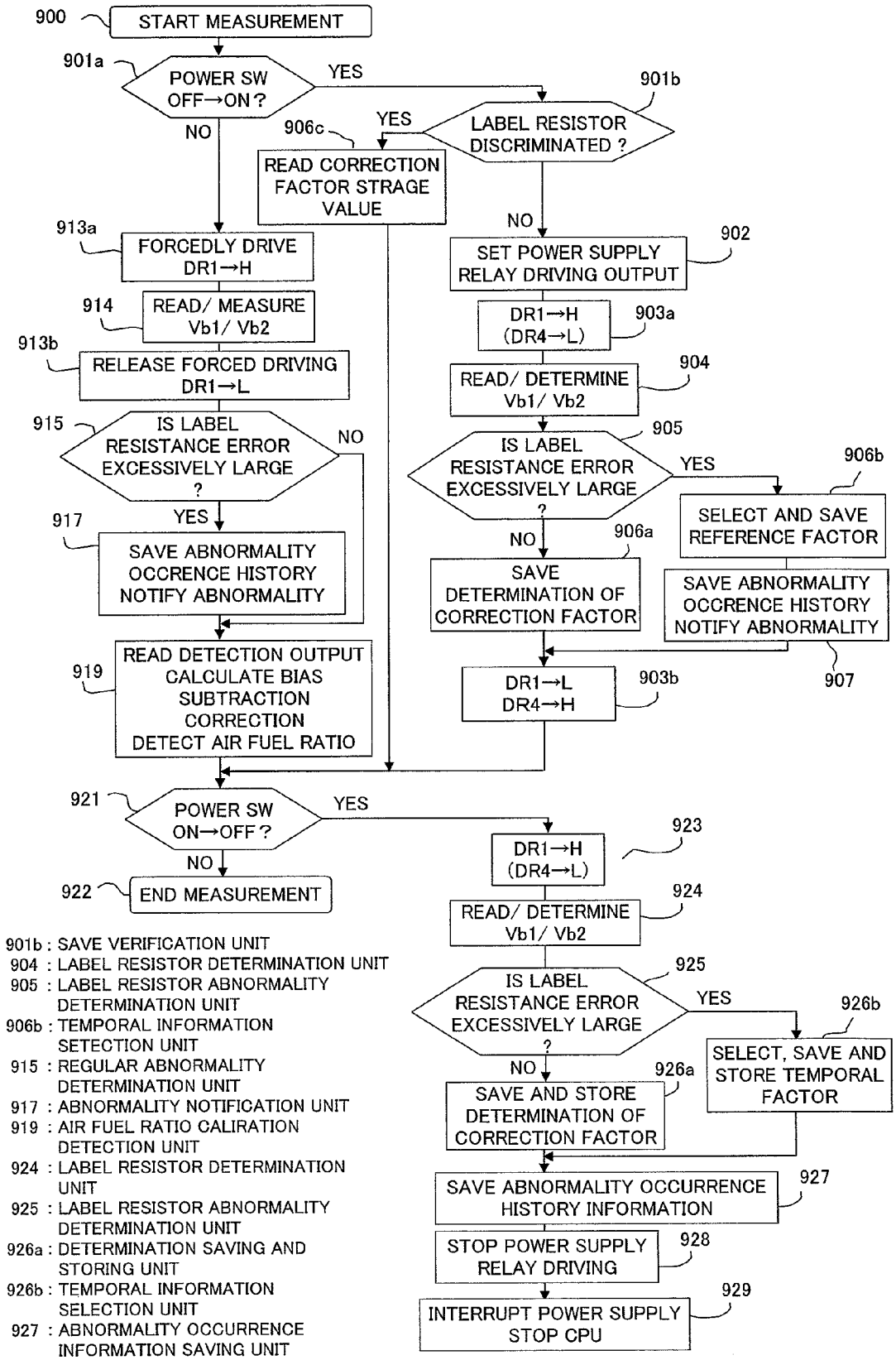

901b : SAVE VERIFICATION UNIT
904 : LABEL RESISTOR DETERMINATION UNIT
905 : LABEL RESISTOR ABNORMALITY DETERMINATION UNIT
906b : TEMPORAL INFORMATION SETECTION UNIT
915 : REGULAR ABNORMALITY DETERMINATION UNIT
917 : ABNORMALITY NOTIFICATION UNIT
919 : AIR FUEL RATIO CALIRATION DETECTION UNIT
924 : LABEL RESISTOR DETERMINATION UNIT
925 : LABEL RESISTOR ABNORMALITY DETERMINATION UNIT
926a : DETERMINATION SAVING AND STORING UNIT
926b : TEMPORAL INFORMATION SELECTION UNIT
927 : ABNORMALITY OCCURRENCE INFORMATION SAVING UNIT

VEHICLE-MOUNTED ENGINE CONTROL APPARATUS

BACKGROUND OF THE INVENTION

1. Field of the Invention

The present invention relates to a vehicle-mounted engine control apparatus that is capable of improving the air fuel ratio detection accuracy of an exhaust gas sensor used to properly control an air fuel ratio (a ratio of an amount of intake air to an amount of fuel injected) of a mixture in a vehicle-mounted engine. In particular, it relates to such a vehicle-mounted engine control apparatus that is improved to correct a change in individual variation of an exhaust gas sensor.

2. Description of the Related Art

In the past, in vehicle-mounted engine control apparatuses, there has been used an LAFS (Linear Air/Fuel Sensor) which is composed in combination of an oxygen concentration cell element and an oxygen pump element and which acts as an exhaust gas sensor for controlling an air fuel ratio (a ratio of an amount of intake air detected by an intake air amount sensor that measures or estimates an amount of intake air with respect to an amount of fuel supplied that is determined by a period of fuel injection) to a proper value in a negative feedback manner, In addition, in a vehicle-mounted engine control apparatus using such a kind of exhaust gas sensor, various methods are adopted so as to prevent the deterioration of control precision resulting from a change in individual variation of the air fuel ratio detection characteristic of the exhaust gas sensor.

For example, as one example of a conventional vehicle-mounted engine control apparatus, there has been proposed a gas concentration detection apparatus having a gas sensor and a gas sensor connector (see, for example, a first patent document to be described later).

In the conventional apparatus described in the first patent document, the connector is connected through a cable to one end of a sensor main body through which a first pump current corresponding to the concentration of oxygen in a gas to be measured and a second pump current corresponding to the concentration of NOx in the gas flow.

In addition, the connector is provided, besides terminals for inputting and outputting signals to the sensor main body, with a label resistor that has a resistance value corresponding to the characteristic of the sensor main body (the relation between the oxygen concentration and the first pump current, and the relation between the NOx concentration and the second pump current), and a label signal output terminal connected to opposite ends of the label resistor.

In the above-mentioned construction, the characteristic of the sensor main body is specified by identifying the resistance value of the label resistor through the terminals, and the oxygen concentration and the NOx concentration are obtained from the detected values of the first and second pump currents with a high degree of precision based on the characteristic of the sensor main body thus specified.

On the other hand, as another conventional apparatus, there has been proposed a control apparatus for an internal combustion engine which is provided with a linear air fuel ratio sensor mounted on an exhaust pipe of an internal combustion engine for linearly measuring the air fuel ratio of an exhaust gas, an air fuel ratio control unit for correcting the air fuel ratio in the internal combustion engine in accordance with an output value of the linear air fuel ratio sensor, and a correction resistor for correcting an amount of error of the linear air fuel ratio sensor corresponding to an error between an output characteristic of the linear air fuel ratio sensor and a reference value (see, for example, a second patent document to be described later).

According to the conventional apparatus described in the second patent document, correction methods for the linear air fuel ratio sensor can be unified or standardized by correcting the output characteristic of the linear air fuel ratio sensor, so the number of kinds of linear air fuel ratio sensors is decreased and the amount of handling or dealing for each kind thereof can be increased, thus making it possible to achieve cost reductions.

In addition, by performing the reading of the error correction value at the time of initialization, there is no possibility of causing large damage to the sensors due to incorrect combinations, so the degree of freedom in combination of sensors and control circuits can be increased.

[First Patent Document]

Japanese patent application laid-open No. H11-281617 (FIGS. 2 and 4, paragraphs 0044 and 0054)

[Second Patent Document]

Japanese patent application laid-open No. 2002-256935 (FIGS. 2 and 25, and paragraphs 0030 and 0031

SUMMARY OF THE INVENTION

However, there have been the following problems in the above-mentioned conventional techniques.

That is, according to the gas concentration detection apparatus described in the first patent document, the resistance value of the label resistor is detected at the detection apparatus side, and is able to be corrected in a multistage manner by means of software, but the opposite ends of the label resistor for correcting the change in individual variation of the gas sensor are connected through the connector to the detection apparatus so as to detect the concentration of oxygen and the concentration of NOx contained in the exhaust gas with a high degree of precision. As a result, there has been a problem that the number of terminals and the number of wiring lines of the connector are increased.

On the other hand, according to the control apparatus for an internal combustion engine described in the second patent document, the correction of the detection signal output can be made by hardware in the engine control unit, whereby the number of signal wiring lines can be suppressed to an increase of only one line. However, in order to detect the oxygen concentration and the NOx concentration of the exhaust gas with a high degree of precision, a correction resistor for correcting the change in individual variation of the gas sensor is arranged in the interior of the sensor, and the correction resistor is connected in parallel to a reference resistor in the engine control unit. Accordingly, there has been a problem that the possibility of noise malfunction is increased due to the increased number of signal lines (even though an increase of only one line) connected directly to a sensor circuit of high resistivity. In addition, there has been another problem that when connecting wiring of the correction resistor is open circuited (disconnected) or short circuited, the detection characteristic of the exhaust gas sensor becomes abnormal in spite of the fact that the exhaust gas sensor itself is normal.

The present invention is intended to obviate the problems as referred to above, and has for its object to provide a vehicle-mounted engine control apparatus which is capable of suppressing an increase in signal wiring between an exhaust gas sensor and the vehicle-mounted engine control apparatus to a minimum, and correcting a change in individual variation of the exhaust gas sensor while avoiding the possibility of noise malfunction by constructing one added signal line in such a manner that it is not directly connected to a sensor circuit part of the exhaust gas sensor.

Bearing the above object in mind, according to the present invention, there is provided a vehicle-mounted engine control apparatus which is fed with electric power from an on-vehicle battery through a first power wire thereby to control a group of engine driving electric loads including a fuel injection electromagnetic valve when a power switch is turned on in response to an operating state of an exhaust gas sensor for measuring an air fuel ratio and an operating state of a group of sensors including at least an intake air amount sensor to measure or estimate an amount of intake air for monitoring an operating state of a vehicle-mounted engine, wherein the exhaust gas sensor is provided with a label resistor that becomes an index for selecting a correction factor for characteristic variation of air fuel ratio measurement elements, and an electric heater to raise the temperature of this exhaust gas sensor to an activation temperature thereof at an early time.

A positive terminal, to which one end of the label resistor and one end of the electric heater are connected, is connected to an on-vehicle battery through a second power wire, and a negative end of the label resistor and a negative end of the electric heater are connected to the vehicle-mounted engine control apparatus through separate individual wires, respectively.

As the resistance value of the label resistor, there is selected and used, from among a series of numerical values, one which lies in a predetermined error range around one of the series of numerical values changing in multiple stages.

The vehicle-mounted engine control apparatus includes a microprocessor, a nonvolatile program memory, a RAM memory, a nonvolatile data memory, and a multichannel AD converter, all of which cooperate with one another, and further includes a positive end potential measurement circuit for the label resistor, and a negative end potential measurement circuit that measures a voltage across opposite ends of a given fixed resistor connected in series to an negative end of the label resistor.

The nonvolatile program memory further includes a control program that constitutes a label resistor discrimination unit, a data table or an approximation equation for a standard characteristic of a detection signal output versus air fuel ratio of the exhaust gas sensor, and a data table or a conversion data in the form of an approximation equation for the value of a correction factor K corresponding to the discriminated label resistor.

In order to estimate a power feed voltage from the on-vehicle battery applied to a positive terminal of the label resistor based on the potential of a vehicle body to which a negative terminal of the on-vehicle battery is connected, the positive end potential measurement circuit is composed of voltage dividing resistors that serve to divide a second power feed voltage fed from the second power wire thereby to input it to the multichannel AD converter.

The positive end potential measurement circuit is a circuit that serves to input the voltage across the opposite ends of the fixed resistor to the multichannel AD converter.

The label resistor discrimination unit calculates a current supplied to the label resistor by dividing the voltage across the opposite ends of the fixed resistor input to the microprocessor through the multichannel AD converter by a given fixed resistance value, calculates the resistance value of the label resistor by dividing the voltage across the opposite ends of the label resistor, which is obtained by subtracting a negative end potential of the label resistor from a positive end potential thereof, by the current supplied to the label resistor, and specifies the label resistor of which order stored as the conversion data the calculated resistance value is.

The microprocessor controls an amount of injection fuel so as to obtain a predetermined air fuel ratio in response to the value of a detection signal output of the exhaust gas sensor, the resistance value of the label resistor, and the value of the conversion data.

According to the present invention, in a vehicle-mounted engine control apparatus that controls the amount of injection fuel in response to a detection signal output of an air fuel ratio by an exhaust gas sensor, a correction factor for correcting the individual variation of the detection signal output of the air fuel ratio of the exhaust gas sensor is selected by the resistance value of a label resistor attached to the exhaust gas sensor, and besides, one end of the label resistor is connected with a positive terminal of the electric heater. With such an arrangement, the following advantageous effects can be obtained. That is, the number of pins of a connector and the number of wires of the exhaust gas sensor can be reduced as compared with the case where independent wirings are provided respectively for the opposite ends of the label resistor, as a result of which the output characteristic of the individual exhaust gas sensor can be corrected in an accurate manner by means of the correction factor thus selected.

In addition, the following advantageous effect can be obtained. Since the label resistor is not connected to the air fuel ratio detection element, it does not influence the air fuel ratio detection characteristic of the air fuel ratio detection element, and the influence of noise-induced malfunction can be reduced.

In addition, the resistance value of the label resistor is calculated by measuring the positive terminal potential and the negative terminal potential of the label resistor, and using the resistance value of the given fixed resistor, and at the same time, as the resistance value of the label resistor to be applied, there is selected and used one which lies in a predetermined error range around one of the series of numerical values of multiple stages. Accordingly, even if the resistance value of the label resistor is changed according to the environmental temperature, or even if a voltage variation of the power wire is generated, it is possible to specify the correction factor to be applied in an accurate manner as long as such a change or variation is within a predetermined variation range.

The above and other objects, features and advantages of the present invention will become more readily apparent to those skilled in the art from the following detailed description of preferred embodiments of the present invention taken in conjunction with the accompanying drawings.

BRIEF DESCRIPTION OF THE DRAWINGS

FIG. 4 is an explanatory view showing a conversion data table of an exhaust gas sensor in the apparatus of FIG. 1.

FIG. 6 is a flow chart explaining a measurement operation of the apparatus of FIG. 5.

FIG. 9 is an explanatory view showing a conversion data table of an exhaust gas sensor in the apparatus of FIG. 8.

FIG. 10 is a flow chart explaining a measurement operation of the apparatus of FIG. 8.

FIG. 11 is a flow chart showing a measurement operation according to another construction example of the third embodiment of the present invention.

DETAILED DESCRIPTION OF THE PREFERRED EMBODIMENTS

Embodiment 1

Hereinafter, preferred embodiments of the present invention will be described while referring to the accompanying drawings.

Figure 1:
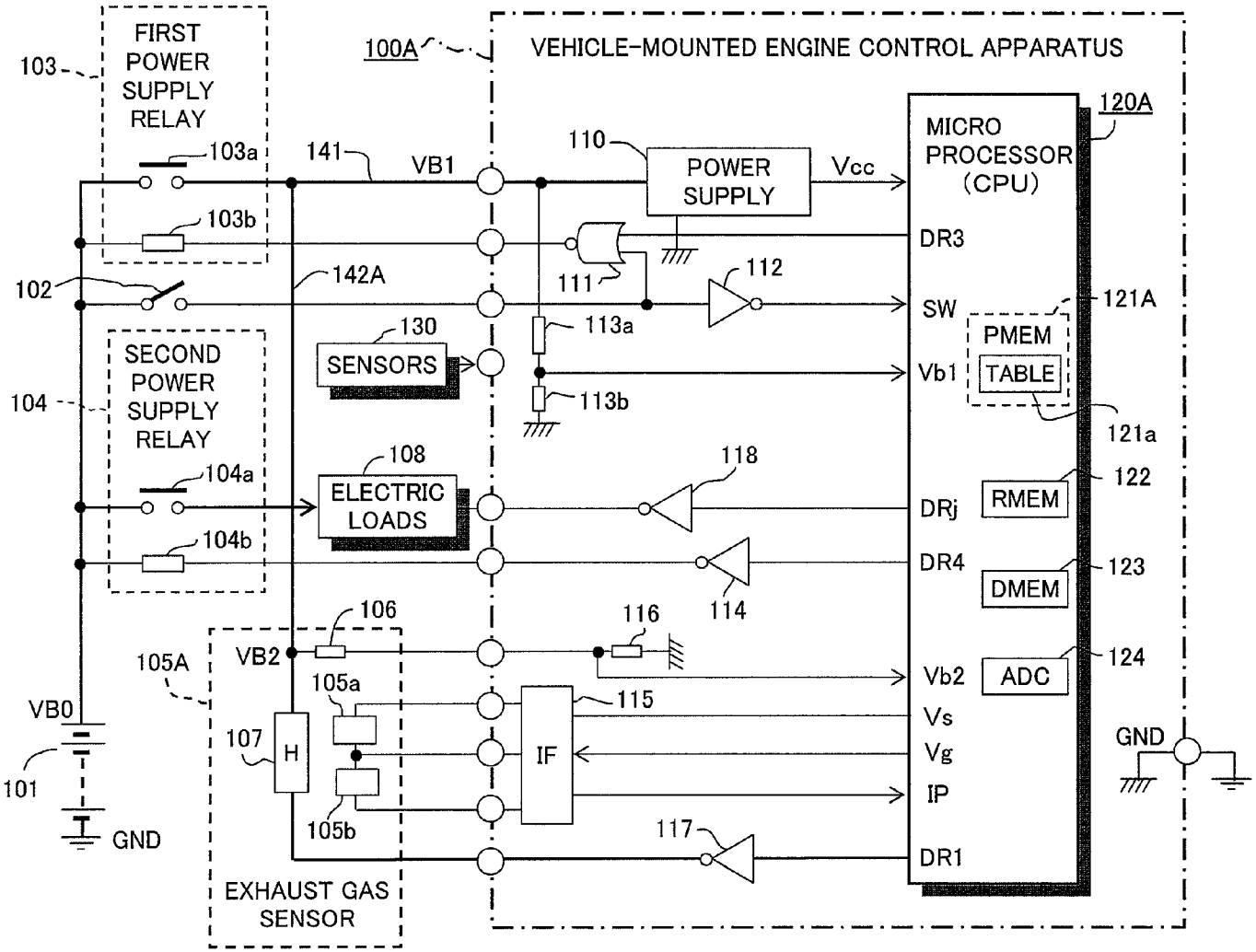
FIG. 1 is a block diagram showing the overall construction of a vehicle-mounted engine control apparatus according to a first embodiment of the present invention.

FIG. 1 is a block diagram showing the overall construction of a vehicle-mounted engine control apparatus according to a first embodiment of the present invention.

In FIG. 1, a vehicle-mounted engine control apparatus 100A comprising an electronic control unit is composed of a microprocessor (CPU) 120A as its main component, and is operated by a power feed voltage VB0 from an on-vehicle battery 101.

First of all, as circuit elements which are externally connected to the vehicle-mounted engine control apparatus 100A, there are provided a power switch 102 connected to a positive terminal of the on-vehicle battery 101, a first and a second power supply relay 103, 104, an exhaust gas sensor 105A connected to the first power supply relay 103, and an electric load group 108 (hereinafter simply referred to as "electric loads 108") connected to the second power supply relay 104.

The first power supply relay 103 is provided with an output contact 103*a* and an excitation coil 103*b*, and the excitation coil 103*b* is energized by the closing (on) of the power switch 102.

The output contact 103*a* is caused to close by the energization of the excitation coil 103*b*, whereby electric power is fed from the output contact 103*a* to the vehicle-mounted engine control apparatus 100A through a first power wire 141.

The second power supply relay 104 is provided with an output contact 104*a* and an excitation coil 104*b*, and the excitation coil 104*b* is energized based on a command signal (load power supply turn-on command signal) DR4 of the microprocessor 120A.

The output contact 104*a* is caused to close by the energization of the excitation coil 104*b* to feed electric power to the electric loads 108.

The exhaust gas sensor 105A is provided with an oxygen concentration cell element 105*a*, an oxygen pump element 105*b*, a label resistor 106, and an electric heater 107. The oxygen concentration cell element 105*a* and the oxygen pump element 105*b* together constitute an air fuel ratio measurement element.

The label resistor 106 is provided for correcting the characteristic variation of the air fuel ratio measurement element (i.e., the oxygen concentration cell element 105*a* and the oxygen pump element 105*b*).

the electric heater 107 is provided for raising the temperature of the exhaust gas sensor 105A to a predetermined activation temperature in a quick manner.

A positive terminal of the label resistor 106 and a positive terminal of the electric heater 107 are connected to each other, and electric power is fed from the output contact 103*a* of the first power supply relay 103 to these positive terminals through a second power wire 142A.

The electric loads 108 include at least a fuel injection electromagnetic valve, and at the same time include other components such as ignition coils (in case of a gasoline engine), a plurality of actuators such as intake valve opening control motors, etc., required to drive the engine. The electric loads 108 are driven and controlled by a plurality of command signals (electric load driving command signals) DRj of the microprocessor 120A.

In addition, a sensor group 130 (hereinafter simply referred to as "sensors 130") is provided for observing an operating state of the engine, and detection signals of the sensors 130 are input to the microprocessor 120A through an interface circuit (not shown).

The sensors 130 includes at least an intake air amount sensor that measures (or estimates) an amount of intake air, and at the same time includes other opening and closing sensors (e.g., an engine rotation sensor, a crank angle sensor, etc.), an accelerator position sensor for detecting the degree of depression of an accelerator pedal, and various analog sensors (e.g., a throttle position sensor for detecting the degree of opening of an intake throttle valve, etc.).

On the other hand, the vehicle-mounted engine control apparatus 100A having the microprocessor 120A is provided, as its internal configuration to cooperate with the microprocessor 120A, with a control power supply 110, a power supply relay driving circuit 111, a power supply turn-on monitoring circuit 112, voltage dividing resistors 113*a*, 113*b*, a drive element 114, a control circuit 115 of the exhaust gas sensor 105A, a fixed resistor 116, a switching element 117, and an electric load driving element 118.

The control power supply 110 receives a first power feed voltage VB1 from the first power wire 141, and generates a stabilized drive voltage Vcc (e.g., DC 5 V), which is supplied to the microprocessor 120A and an I/O interface circuit of the microprocessor 120A.

The power supply relay driving circuit 111 is an OR circuit having an open collector transistor output, and drives the excitation coil 103*b* of the power supply relay 103 when the power switch 102 is closed, or when the logic level of a self-hold command signal DR3 generated by the microprocessor 120A is high ("H").

Here, note that when the microprocessor 120A is powered to be driven to generate the self-hold command signal DR3, the power supply relay driving circuit 111 continues to energize the excitation coil 103*b* even if the power switch 102 is opened (turned off), so the excitation coil 103*b* is deenergized when the microprocessor 120A stops the self-hold command signal DR3.

However, in place of the self-hold command signal DR3, it can be constructed such that the generation interval of a pulse train signal (watchdog signal) for runaway watch generated by the microprocessor 120A is monitored by a watchdog timer circuit (not shown), and the excitation coil 103*b* is energized through the power supply relay driving circuit 111 in response to the fact that the microprocessor 120A is under normal operation.

The power supply turn-on monitoring circuit 112 is composed of an inverting logic element, and generates a power supply turn-on monitoring signal SW which becomes low ("L") when the power switch 102 is closed.

The voltage dividing resistors 113*a*, 113*b* are connected in series to each other, and is fed power from the first power feed voltage VB1, so that a voltage at a voltage dividing point is input to the microprocessor 120A as a first monitor voltage Vb1.

The drive element 114 is in the form of an inverting logic circuit having an open collector transistor output, and is provided for driving the second power supply relay 104. The drive element 114 drives the excitation coil 104*b* into a conductive or energized state when a load power supply turn-on command signal DR4 generated by the microprocessor 120A is at a high logic level "H".

The control circuit 115 supplies a pump current Ip to the oxygen pump element 105*b* so that a voltage Vs generated by the oxygen concentration cell element 105*a* in the exhaust gas sensor 105A becomes a predetermined reference voltage. The control circuit 115 also inputs the value of the pump current Ip to the microprocessor 120A as a detection signal output IP (=Ip) for the air fuel ratio.

The fixed resistor 116 is connected in series to the label resistor 106 in the exhaust gas sensor 105A thereby to constitute a voltage dividing resistor. The fixed resistor 116 is applied with a second power feed voltage VB2, so that the voltage at the voltage dividing point is input to the microprocessor 120A as a second monitor voltage Vb2.

The switching element 117 is provided for driving the electric heater 107 of the exhaust gas sensor 105A, and is composed of an inverting logic element having an open collector transistor output. The switching element 117 is closed to energize and drive the electric heater 107 when a switching command signal DR1 generated by the microprocessor 120A is at a high logic level "H".

The switching element 117 is applied with an average voltage corresponding to the duty of energization from the electric heater 107, so that it controls the temperature of the exhaust gas sensor 105A to the predetermined activation temperature.

The electric load driving element 118 is composed of a plurality of inverting logic circuits including an output transistor. When the electric load driving command signal DRj generated by the microprocessor 120A is at a high logic level "H", the output transistor of the electric load driving element 118 is closed to drive one of the plurality of the electric loads 108.

The microprocessor 120A is provided with a nonvolatile program memory (PMEM) 121A comprising a nonvolatile flash memory for example, a RAM memory (RMEM) 122 for calculation processing, a nonvolatile data memory (DMEM) 123 comprising an EEPROM memory for example, and a multichannel AD converter (ADC) 124 for analog sensors contained in the sensors 130. The microprocessor 120A operates in cooperation with these elements 121A and 122-124.

The respective elements 121A and 122-124 in the microprocessor 120A are consolidated as, for example, one integrated circuit device.

Figure 2:
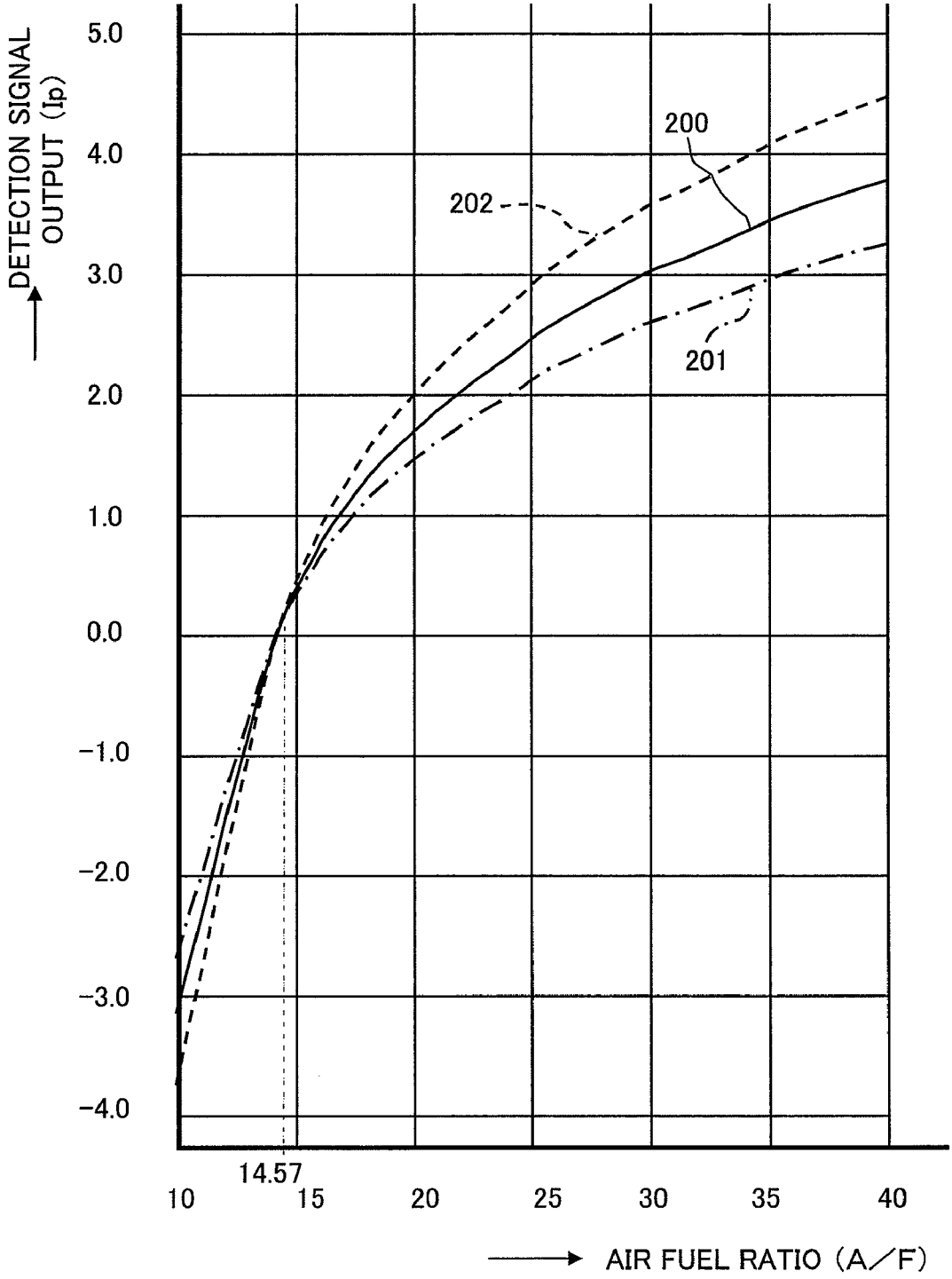
FIG. 2 is an explanatory view showing the output characteristic of an exhaust gas sensor according to the first embodiment of the present invention.

FIG. 2 is an explanatory view showing the output characteristic of the exhaust gas sensor 105A, wherein the pump current (detection signal output) Ip supplied to the oxygen pump element 105*b* is illustrated.

In FIG. 2, the axis of abscissa represents an air fuel ratio NF (percentage by weight of air/fuel), and the axis of ordinate represents the detection signal output Ip (the value of the pump current supplied to the exhaust gas sensor 105A). A solid line curve denotes a standard output characteristic 200, and an alternate long and short dash line curve denotes a lower limit output characteristic 201, and a broken line curve denotes an upper limit output characteristic 202.

As is clear from FIG. 2, the standard output characteristic 200, the lower limit output characteristic 201, and the upper limit output characteristic 202 are positive and negative linear values with respect to the boundary of a stoichiometric air fuel ratio (=14.57) of the exhaust gas.

Accordingly, it is constructed such that the microprocessor 120A applies a bias voltage Vg as a voltage Vp across the opposite ends of a current detection resistor Rs (not shown) connected in series to a pump current supply circuit (not shown), and a corrected input signal voltage Vin, which has been converted into a positive value, is input to the multichannel AD converter 124.

For example, assuming that the pump current Ip=5 mA, the current detection resistance Rs=300Ω, and the bias voltage Vg=2.5 V, the corrected input signal voltage Vin to the multichannel AD converter 124 is represented by the following expression (1).

$$Vin=Vg+Ip\times Rs=2.5\pm1.5(V) \quad (1)$$

In addition, a control program (see FIG. 3) and conversion data (table) 121*a* to be described later in addition to a communication control program and an input and output control program are stored in the nonvolatile program memory 121A.

Now, reference will be made to the output characteristic of the exhaust gas sensor 105A while referring to FIG. 2.

In FIG. 2, the standard output characteristic 200 is the result calculated as an average value of the detection signal output characteristics of a lot of exhaust gas sensors, and it is stored in the nonvolatile program memory 121A as an approximation equation or conversion data in the form of a data table.

Here, note that for example, the following expression (2) can be used as an approximation equation for a calibrated value Ipp of the pump current in the standard output characteristic 200.

$$Ipp=K1(1-\lambda)+K2(1-1/\lambda) \quad (2)$$

Here, in expression (2) above, λ is equal to (A/F)/14.57 (i.e., the value of the air fuel ratio normalized by the stoichiometric air fuel ratio), and K1 and K2 are constants, respectively.

The lower limit output characteristic 201 is a detection signal output characteristic of the exhaust gas sensor 105A which becomes a lower limit of an allowable change in individual variation thereof, and it is, for example, a value of 80% of the standard output characteristic 200.

In addition, the upper limit output characteristic 202 is a detection signal output characteristic of the exhaust gas sensor 105A which becomes an upper limit of an allowable change in individual variation thereof, and it is, for example, a value of 120% of the standard output characteristic 200.

Next, reference will be made to a measurement operation according to the first embodiment of the present invention as illustrated in FIG. 1 while referring to an explanatory view of FIG. 4 together with the explanatory view of FIG. 2 and the flow chart of FIG. 3.

FIG. 4 illustrates a conversion data table of the exhaust gas sensor 105A.

First of all, in FIG. 1, when the power switch 102 is closed to energize the excitation coil 103*b* through the power supply relay driving circuit 111, the on-vehicle battery 101 is connected to the vehicle-mounted engine control apparatus 100A through the output contact 103*a* of the power supply relay 103, so that the drive voltage Vcc is applied to the microprocessor 120A through the control power supply 110.

The microprocessor 120A drives and controls the electric loads 108 (including at least the fuel injection electromagnetic valve) and the electric heater 107 in the exhaust gas sensor 105A in response to the operating state of the sensors 130 (including at least the intake air amount sensor for measuring or estimating the amount of intake air) and the operating state of the exhaust gas sensor 105A as well as the contents of the control programs in the nonvolatile program memory 121A.

Figure 3:
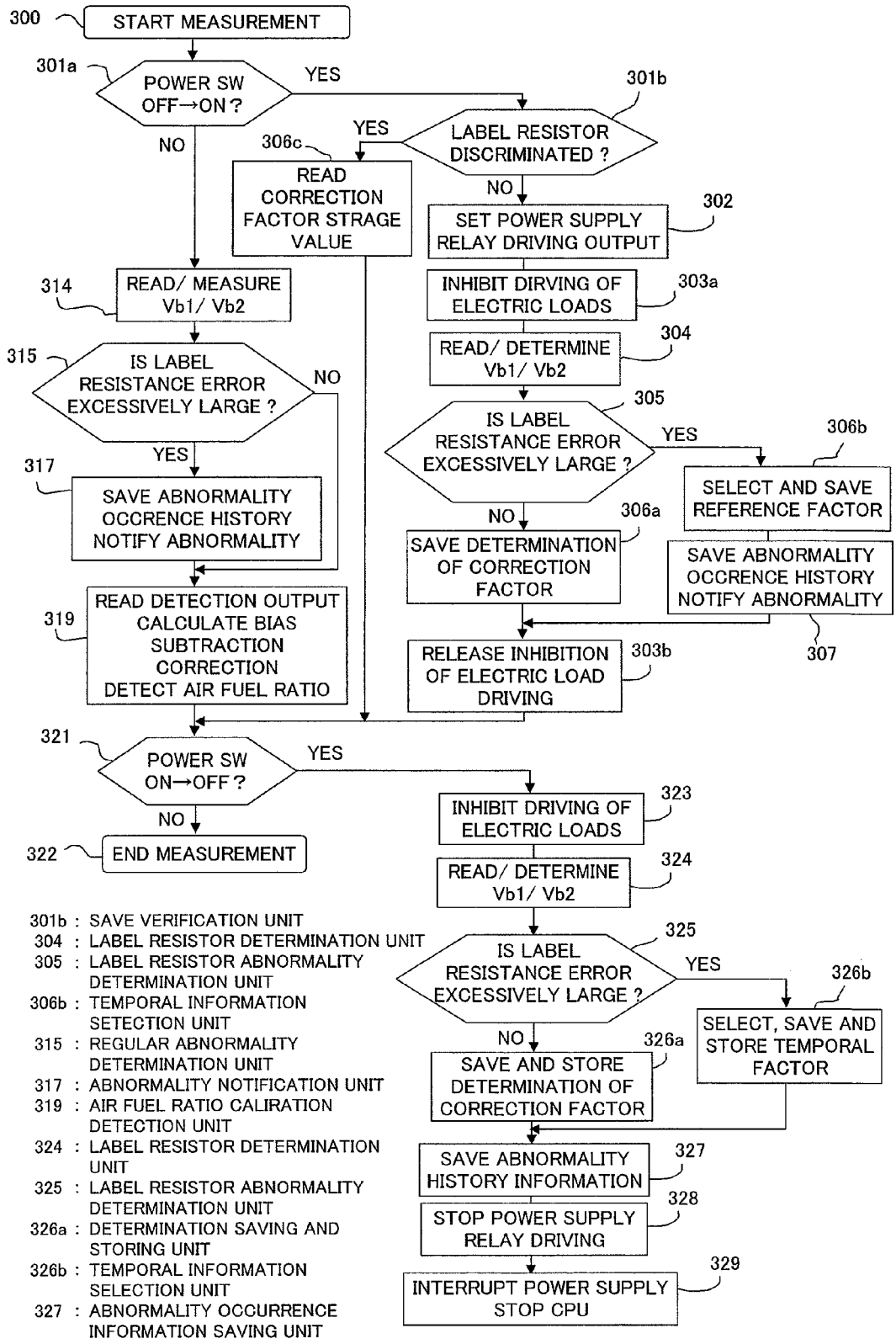
FIG. 3 is a flow chart explaining a measurement operation of the apparatus of FIG. 1.

However, the measurement operation of the label resistor 106 in FIG. 3 is performed prior to these ordinary control operations.

In addition, when the power switch 102 is opened, the microprocessor 120A stops the self-hold command signal DR3 after executing a save operation in FIG. 3. As a result, the power supply relay 103 is deenergized to open the output contact 103*a*, whereby the power feed to the vehicle-mounted engine control apparatus 100A is stopped.

In FIG. 3, first of all, the microprocessor 120A starts the measurement operation of the label resistor 106 (step 300), and makes a determination as to whether the power switch 102 has changed from an open state (OFF) into a closed state (ON), by monitoring the power supply turn-on monitoring signal SW from the power supply turn-on monitoring circuit 112 (step 301*a*).

At this time, when immediately after the closure of the power switch 102, the change from the open state (OFF) to the closed state (ON) is detected in step 301*a*, and a positive determination of "YES" is made, so the control flow shifts to step 301*b*. On the other hand, when the power switch 102 is already in a continuously closed operation, no change of the power supply turn-on monitoring signal SW is detected in step 301*a*, and a negative determination of "NO" is made, so the control flow shifts to step 314 (to be described later).

In step 301*b*, it is verified whether the determination result of the label resistor 106 is saved in the nonvolatile data memory 123 in step 326*a* (to be described later) (i.e., whether the determination has already been made).

If the determination has already been made in step 301*b*, a positive determination of "YES" is made, and the control flow shifts to step 306*c*, whereas if the determination has not yet been made, a determination of "NO" is made, and the control flow shifts to step 302.

In step 302, the logic level of the self-hold command signal DR3 to energize the excitation coil 103*b* of the first power supply relay 103 in its self-hold state is set to a high level ("H").

Subsequently, after the driving of the load power supply turn-on command signal DR4 and the electric load driving command signal DRj is inhibited (step 303*a*), the first monitor voltage Vb1 and the second monitor voltage Vb2 are read into the RAM memory 122 for reading and determination, and the discrimination of the label resistor 106 is performed (step 304).

Here, note that in step 304, the first monitor voltage Vb1 is represented according to the following expression (3) by using the first power feed voltage VB1 supplied from the first power wire 141.

$$Vb1=VB1\times R113b/(R113a+R113b) \quad (3)$$

Here, in expression (3) above, R113*a* and R113*b* are the resistance values of the voltage dividing resistors 113*a*, 113*b*, these resistance values are stored in the nonvolatile program memory 121A beforehand.

Accordingly, the microprocessor 120A can calculate the value of the first power feed voltage VB1 by reading out the first monitor voltage Vb1.

In addition, in step 304, the second monitor voltage Vb2 is represented according to the following expression (4) by using the second power feed voltage VB2 supplied from the second power wire 142A.

$$Vb2=VB2\times R0/(R0+Rx) \quad (4)$$

Here, in expression (4) above, Rx is the resistance value of the label resistor 106, and R0 is the resistance value of the fixed resistor 116, and the resistance value R0 is stored in the nonvolatile program memory 121A beforehand.

On the other hand, in FIG. 1, the first and second power wires 141, 142A are both connected to the output contact 103*a* of the first power supply relay 103, so the first power feed voltage VB1 and the second power feed voltage VB2 are substantially equal to each other.

Therefore, the first power feed voltage VB1 calculated from expression (3) can be substituted for the second power feed voltage VB2 in expression (4), and hence the following expression (5) is obtained.

$$R0/(R0+Rx)=(Vb2/Vb1)\times R113b/(R113a+R113b) \quad (5)$$

Here, in expression (5) above, the first and second monitor voltages Vb1, Vb2 are the measured values read out into the RAM memory 122 through the multichannel AD converter 124 in the microprocessor 120A. In addition, the resistance value R0 of the fixed resistor 116 and resistance values R113*a*, R113*b* of the voltage dividing resistors 113*a*, 113*b* are known or given values that are stored in the nonvolatile program memory 121A.

Accordingly, the microprocessor 120A can calculate the resistance value Rx of the label resistor 106 based on expression (5).

Here, note that in case where the second power wire 142A is connected to the output contact 104*a* of the second power supply relay 104, in place of the circuit structure of FIG. 1 (in the case of FIG. 5 to be described later), the excitation coil 104*b* of the second power supply relay 104 is energized by generating the load power supply turn-on command signal DR4 in step 303*a*. In addition, electric power is fed to the exhaust gas sensor 105A by inhibiting the driving of the electric load driving command signal DRj.

Thus, even when the second power wire 142A is connected to the output contact 104*a* of the second power supply relay 104, the first power feed voltage VB1 and the second power feed voltage VB2 are substantially equal to each other due to the stoppage of the driving of the electric loads 108, and hence the resistance value Rx of the label resistor 106 can be calculated from expression (5).

On the other hand, let us denote the reference value for the resistance value of the label resistor 106 as Ri (i=1, 2, . . . , n). When the order i of the label resistor 106 is raised by 1 rank or level to increase the reference value from Ri to $R_{i+1}$, if the value of the second monitor voltage Vb2 decreases at a constant ratio γ, the relation of the following expression (6) holds.

$$\gamma\times R0/(R0+R_{i+1})=R0/(R0+Ri) \quad (6)$$

Here, in expression (6) above, $R_{i+1}$>Ri, and γ>1.

As a specific example, when R0=1 KΩ and γ=1.2 are substituted for in expression (6), the following expression (7) is obtained.

$$R_{i+1}=1.2\times Ri+0.2 \quad (7)$$

Here, in order to adjust the second monitor voltage Vb2 to 5 V or less, R1 is set to 2.2 KΩ, and by substituting this in expression (7) above, R2=2.84 KΩ is obtained, but when a public standard (a preferred number of an E24 series) is used as the label resistor 106, R2=3.0 KΩ is obtained.

Hereinafter, similarly, when R2=3.0 KΩ is substituted for in the expression (7), R3=3.8 KΩ is obtained, but when a preferred number of the E24 series is used similarly, R3=3.9KΩ is obtained.

FIG. 4 illustrates a table of the reference value Ri (i=1, 2, . . . , 21) calculated in the manner as referred to above.

As the label resistor 106, there is used, for example, one of which accuracy (i.e., deviation or variation) is within plus and minus 2% of the reference value Ri indicated in FIG. 4.

In step 304 in FIG. 3, when the first and second monitor voltages Vb1, Vb2 are read out and the resistance value Rx of the label resistor 106 is calculated based on the above-mentioned expression (5), it is searched for the reference value Ri of which order i in FIG. 4 the resistance value Rx thus calculated is close to.

In FIG. 4, it is defined that values around a reference value $R_{i+1}$, being equal to or more than 1.1×Ri and being less than $1.1\times R_{i+1}$, are within the range between a determination lower limit Rmin and a determination upper limit Rmax of values close to the reference value $R_{i+1}$.

In addition, in FIG. 4, a correction factor K corresponding to the reference value Ri is allocated based on the following expression (8).

$$K=1+0.02\times(i-11) \tag{8}$$

Here, in expression (8) above, i=1 through 21.

Accordingly, if it is determined the reference value Ri of which order i the resistance value Rx thus calculated is close to, the correction factor K to be applied will be fixedly decided.

In FIG. 4, when the calculated resistance value Rx is less than 2.0 KΩ, the label order i is "0", and this means that the label resistor 106 is in an abnormally short-circuited state or in a power supply fault state in which negative terminal wiring of the label resistor 106 is in mixed contact with a power supply wire.

The correction factor K in this case is set to 1.0 (i.e., K=1.0), or a value of the correction factor K having already been selected is applied as it is without being changed.

On the other hand, when the calculated resistance value Rx is 242 KΩ or more, the label order i is "22", and this means that the label resistor 106 is open circuited (disconnected) or is in a ground fault state in which the negative terminal wiring of the label resistor 106 is in mixed contact with a vehicle body.

In this case, too, the correction factor K is set to 1.0, or the value of the correction factor K having already been selected is applied as it is without being changed.

Returning to FIG. 3, following the step 304, it is determined whether the value of the resistance value Rx of the label resistor 106, having been read and determined in step 304, is abnormal (excessively large or small) (i.e., in a normal range) (step 305), and if abnormal, a positive determination of "YES" is made, and the control flow shifts to step 306*b*, whereas if normal, a negative determination of "NO" is made, and the control flow shifts to step 306*a*.

In step 306*a*, the correction factor K based on the order i of the label resistor 106 determined in step 304 is written into a first predetermined address of the RAM memory 122.

On the other hand, in step 306*b*, a reference value of K=1.00 is selected as the correction factor K, and is written into the first predetermined address of the RAM memory 122.

In addition, following the step 306*b*, it is identified whether the determination result (label resistor abnormality) in step 305 is a short-circuit/power-supply-fault failure of the label resistor 106, or an open-circuit/ground-fault failure, and an abnormality notification command signal is generated to operate an alarm display device (not shown), and at the same time to write the abnormality identification result (abnormality information) into a second predetermined address of the RAM memory 122 (step 307).

Thereafter, following the step 306*a* or step 307, the driving inhibition state of the electric loads 108 in step 303*a* is released (step 303*b*), after which the control flow shifts to step 321.

On the other hand, in step 306*c* branching from step 301*b*, the value of the correction factor K to be written and saved into a first predetermined address of the nonvolatile data memory 123 in step 326*a* (to be described later) is transferred to and written into the first predetermined address of the RAM memory 122, and the control flow then shifts to step 321.

On the other hand, in step 314 branching from step 301*a*, the resistance value Rx of the label resistor 106 is calculated and the order i thereof is determined, similar to step 304.

Here, note that the step 314 is executed in a repeated manner during the continued operation of the microprocessor 120A, but here, even if a different order i is obtained, the correction factor K is not changed.

Subsequently, similar to the step 305, it is determined whether there is an abnormality in the label resistor 106 (step 315), and if there is an abnormality, a positive determination of "YES" is made, and the control flow shifts to step 317, whereas if there is no normality, a negative determination of "NO" is made, and the control flow shifts to step 319 without executing the step 317.

In step 317, similar to step 307, the abnormality information of the label resistor 106 determined in step 315 is written into a third predetermined address of the RAM memory 122, and at the same time, an abnormality notification command signal is generated to operate the alarm display device (not shown).

Subsequently, in step 319, the digital value of the bias addition is subtracted from the digital conversion value of the corrected input signal voltage Vin (=Vg+Ip×Rs) input to the multichannel AD converter 124 in response to the detection signal output Ip of the exhaust gas sensor 105A, and a positive or negative value (pump current Ip) obtained by dividing the digital conversion value thus subtracted by the value of the current detection resistance Rs is calculated.

In addition, in step 319, by multiplying the pump current Ip by the correction factor K written into the first predetermined address of the RAM memory 122 in either of the steps 306*a*, 306*b* and 306*c*, a calibrated pump current Ipp is obtained from the following expression (9), and an air fuel ratio (A/F) is calculated from the data table corresponding to the standard output characteristic 200 of FIG. 2.

$$Ipp=K\times Ip \tag{9}$$

The data table corresponding to the standard output characteristic 200 is stored in the nonvolatile program memory 121A beforehand.

Here, note that the air fuel ratio λ=(A/F)/14.57 can be calculated from an approximate expression of expression (2) in place of the data table of the standard output characteristic 200.

In step 321 that is executed following the step 303*b*, 306*c* or 319, it is determined whether the power switch 102 has been opened, and if opened, a positive determination of "YES" is made, and the control flow shifts to step 323, whereas if not opened, a negative determination of "NO" is made, and the measurement operation of FIG. 3 is ended (step 322).

Here, note that in step 322, the microprocessor 120A executes other control programs, and returns to the operation starting step 300 again by a predetermined time, after which the control flow in step 301*a* and onward is executed in a repeated manner.

In step 323, the driving of the electric loads 108 is inhibited, similar to step 303*a*.

Subsequently, similar to step 304, the resistance value Rx of the label resistor 106 is calculated and the order i is determined (step 324), after which, similar to the step 305, it is determined whether there is an abnormality in the label resistor 106 (step 325), and if there is an abnormality, a positive determination of "YES" is made, and the control flow shifts to step 326*b*, whereas if there is no abnormality, a negative determination of "NO" is made, and the control flow shifts to step 326*a*.

In step 306*a*, the correction factor K based on the order i of the label resistor 106 determined in step 324 is written and saved in the first predetermined address of the nonvolatile data memory 123.

In step 326*b*, a reference value of K=1.00 is selected as the correction factor K, and is written and saved in the first predetermined address of the nonvolatile data memory 123, or in case where the correction factor K has already been stored in the first predetermined address of the nonvolatile data memory 123, the correction factor K having been saved is kept unchanged.

Thereafter, following the step 326*a* or 326*b*, the abnormality historical information written in the second and third predetermined addresses of the RAM memory 122 in steps 307, 317 is accumulatively added to and saved into the second and third predetermined addresses of the nonvolatile data memory 123. Then, the abnormality information of the label resistor 106 determined in step 325 is written and stored into a fourth predetermined address of the nonvolatile data memory 123 (step 327).

Finally, the self-hold command signal DR3 is stopped to deenergize the excitation coil 103*b* of the first power supply relay 103 (step 328), after which electric power supplied to the vehicle-mounted engine control apparatus 100A is interrupted to stop the microprocessor (CPU) 120A (step 329), and the measurement processing of FIG. 3 is terminated.

To summarize the above-mentioned control flow (FIG. 3), a series of processing in steps 323 through 329 are executed after the power switch 102 having been turned on is opened.

In particular, the step 324 corresponds to a label resistor discrimination unit, and the step 325 corresponds to a label resistor abnormality determination unit. The step 326*a* corresponds to a determination saving and storing unit, and the step 326*b* corresponds to a tentative information selection unit. The step 327 corresponds to an abnormality occurrence information storage unit.

In addition, a series of processing in steps 301*b* through 303*b* are executed immediately after the power switch 102 is closed.

In particular, the step 301*b* corresponds to a save verification unit, and the step 304 corresponds to the label resistor discrimination unit. The step 305 corresponds to the label resistor abnormality determination unit, and the step 306*b* corresponds to the tentative information selection unit.

Further, a series of processing in steps 301*a* through 319 are executed in a repeated manner when the power switch 102 is continuously turned on.

The step 315 corresponds to a regular abnormality determination unit, and the step 317 corresponds to an abnormality notification unit, and the step 319 corresponds to an air fuel ratio calibration detection unit.

According to the control flow of FIG. 3, when the determination result of the label resistor is once saved and stored according to step 326*a*, it becomes unnecessary to do the discriminating operation of the label resistor according to step 304, so the control load of the microprocessor 120A at the time of engine starting comes to be reduced.

Here, note that in FIG. 1, it is constructed such that the output contact 103*a* of the first power supply relay 103 feeds electric power to the vehicle-mounted engine control apparatus 100A and the exhaust gas sensor 105A, and the output contact 104*a* of the second power supply relay 104 feeds electric power to the electric loads 108, but such a construction can be modified or changed as follows. That is, electric power can be fed from the output contact 103*a* to a part of the electric loads 108, or electric power can be fed from the power switch 102 to another part of the electric loads 108, or a power supply relay (not shown) can be added for those of the electric loads 108 in which the vehicle-mounted engine control apparatus 100A is not involved.

In addition, although the second power wire 142A for feeding electric power to the exhaust gas sensor 105A is connected to the output contact 103*a*, it can be connected to the power switch 102, the output contact 104*a*, or the like, without being connected to the output contact 103*a*.

In this case, a slight difference is generated between the second power feed voltage VB2 and the first power feed voltage VB1, but the resistance value Rx of the label resistor 106 changes in stages, so there is no fear that the order of the label resistor 106 might be erroneously determined.

As described above, the vehicle-mounted engine control apparatus 100A according to the first embodiment of the present invention (FIG. 1 through FIG. 4) has, as a first feature (corresponding to claim 1), the following construction. That is, when the power switch 102 is turned on, in response to the operating state of the exhaust gas sensor 105A for measuring the air fuel ratio and the operating state of the sensors 130 (including at least an intake air amount sensor for measuring or estimating the amount of intake air) for monitoring or watching the operating state of the vehicle-mounted engine, the vehicle-mounted engine control apparatus 100A is fed with electric power from the on-vehicle battery 101 through the first power wire 141 thereby to control the electric loads 108 for the driving of the engine (including a fuel injection electromagnetic valve).

The exhaust gas sensor 105A is provided with the label resistor 106 that becomes an index for selecting the correction factor K for the characteristic variation of the air fuel ratio measurement elements 105*a*, 105*b*, and the electric heater 107 that serves to raise the temperature of the exhaust gas sensor 105A to an activation temperature at an early time.

A positive terminal, to which one end of the label resistor 106 and one end of the electric heater 107 are connected, is connected to the on-vehicle battery 101 through the second power wire 142A. In addition, the negative end of the label resistor 106 and the negative end of the electric heater 107 are connected to the vehicle-mounted engine control apparatus 100A through individual wires, respectively.

As the resistance value Rx of the label resistor 106, there is selected and used, from among a series of numerical values, one which lies in a predetermined error range around one of the series of numerical values changing in multiple stages.

The vehicle-mounted engine control apparatus 100A is provided with the microprocessor 120A and other components including the nonvolatile program memory 121A, the RAM memory 122, the nonvolatile data memory 123, and the multichannel AD converter 124, all of which cooperate with one another in the microprocessor 120A. The vehicle-mounted engine control apparatus 100A is further provided with positive end potential measurement circuits 113*a*, 113*b* for the label resistor 106, and a negative end potential measurement circuit that measures a voltage across the opposite ends of the known or given fixed resistor 116 connected in series to the negative end of the label resistor 106.

In addition, the nonvolatile program memory 121A is provided with a control program, which constitutes a label resistor discrimination unit (steps 304, 324), and the conversion data 121*a*.

The conversion data 121*a* includes the data table (or approximation equation) for the standard characteristic 200 of the detection signal output Ip versus the air fuel ratio A/F of the exhaust gas sensor 105A, and the data table (or approximation equation) for the value of the correction factor K corresponding to the discriminated label resistor 106.

The positive end potential measurement circuit is a circuit that serves to input the voltage across the opposite ends of the fixed resistor 116 to the multichannel AD converter 124. In order to estimate the power feed voltage VB2 from the on-vehicle battery 101 applied to the positive terminal of the label resistor 106 based on the potential of the vehicle body to which the negative terminal of the on-vehicle battery 101 is connected, the positive end potential measurement circuit is composed of the voltage dividing resistors 113*a*, 113*b* that serve to divide the first power feed voltage VB1 fed from the first power wire 141 thereby to input it to the multichannel AD converter 124.

The label resistor discrimination unit (steps 304, 324) calculates a current supplied to the label resistor 106 by dividing the voltage across the opposite ends of the fixed resistor 116 input to the microprocessor 120A through the multichannel AD converter 124 by a known or given fixed resistance value.

In addition, the label resistor discrimination unit calculates the resistance value Rx of the label resistor 106 by dividing the voltage across the opposite ends of the label resistor 106, which is obtained by subtracting the negative end potential of the label resistor 106 from the positive end potential thereof, by the current supplied to the label resistor 106, and specifies the label resistor of which order i stored as the conversion data 121*a* the calculated resistance value Rx is.

Further, the microprocessor 120A controls the amount of injection fuel so as to obtain a predetermined air fuel ratio (A/F) in response to the value of the detection signal output Ip of the exhaust gas sensor 105A, the resistance value Rx of the label resistor 106, and the value of the conversion data 121*a*.

Moreover, as a second feature (corresponding to claim 2), the positive end potential measurement circuits 113*a*, 113*b* divide the first power feed voltage VB1 applied to the vehicle-mounted engine control apparatus 100A through the first power wire 141, and input it to the multichannel AD converter 124 as a voltage corresponding to the second power feed voltage VB2 applied to the positive terminal of the label resistor 106 through the second power wire 142A.

Further, at a point in time immediately after the power switch 102 is turned on, or at least at a point in time at which the power feed to the electric heater 107 and all or part of the electric loads 108 is not performed, in a period in which the power feed to the vehicle-mounted engine control apparatus 100A is continued for a short time after the power switch 102 is interrupted, the label resistor discrimination unit (steps 304, 324) discriminates or determines the resistance value Rx of the label resistor 106.

Thus, the positive end potential of the label resistor 106 is measured by the voltage fed to the vehicle-mounted engine control apparatus 100A, and a label resistor determination unit (steps 304, 324) is executed in a state in which the power feed to the electric loads 108 is stopped.

Accordingly, the power feed to the electric loads 108 is stopped and a voltage drop in each of the power wires 141, 142A is limited, so the voltage applied to the positive terminal of the label resistor 106 can be easily estimated by measuring the voltage applied to the vehicle-mounted engine control apparatus 100A.

In addition, the measurement of the voltage applied to the vehicle-mounted engine control apparatus 100A is also used for other purposes in the control (e.g., control of the voltage fed to the electric loads 108, etc.) according to the vehicle-mounted engine control apparatus 100A, and hence an economical and inexpensive control apparatus of unnecessary can be obtained.

In addition, as a third feature (corresponding to claim 3), the vehicle-mounted engine control apparatus 100A is fed with electric power through the output contact 103*a* of the first power supply relay 103 that is energized at the time when the power switch 102 is closed, and the exhaust gas sensor 105A is also fed with electric power through the output contact 103*a* of the first power supply relay 103. Thus, a common power wire is used as the power wire extending from the on-vehicle battery 101 to the output contact 103*a* of the first power supply relay 103.

Thus, it is constructed such that the vehicle-mounted engine control apparatus 100A and the exhaust gas sensor 105A are fed with electric power through the first power supply relay 103.

Accordingly, even if the voltage drop of the power wire of the on-vehicle battery 101 is caused to vary due to the power feed to vehicle-mounted electric loads which are not controlled by the vehicle-mounted engine control apparatus 100A, the voltage applied to the positive terminal of the label resistor 106 can be accurately estimated by measuring the voltage applied to the vehicle-mounted engine control apparatus 100A.

In addition, as a fourth feature (corresponding to claim 9), the nonvolatile program memory 121A is further provided with a control program which constitutes a determination saving and storing unit (step 326*a*) and a save verification unit (step 301*b*).

The determination saving and storing unit (step 326*a*) discriminates the label resistor 106 by means of the label resistor discrimination unit (step 324) in a predetermined period in which the power feed to the vehicle-mounted engine control apparatus 100A is continued for a short time after the power switch 102 is opened, and saves and stores the reference value Ri of the label resistor 106 thus discriminated, or the order i of the reference value Ri, or the value of the correction factor K corresponding to the reference value Ri, into the nonvolatile data memory 123.

The save verification unit (step 301*b*) is executed, immediately after the power switch 102 is closed, to determine whether the discrimination result of the label resistor 106 has already been saved in the nonvolatile data memory 123 by means of the determination saving and storing unit (step 326*a*). If verified and saved, the discrimination result stored in the nonvolatile data memory 123 is read out and saved in the RAM memory 122, whereas if the discrimination result is not stored in the nonvolatile data memory 123, the label resistor discrimination unit (step 304) is executed, so that the discrimination result is written and saved into the RAM memory 122.

Thus, the discrimination result based on the label resistor 106 measured immediately after the power switch 102 is opened is saved in the nonvolatile data memory 123, and when the power switch 102 is closed again, the discrimination result having been saved is applied, whereas if the discrimination result is not stored when the power switch 102 is closed, the measurement processing of the label resistor 106 is executed so as to obtain a new discrimination result.

Accordingly, in a production line of motor vehicles, the label resistor discrimination unit (step 324) to be performed immediately after the turning-on of the power switch 102 is not executed except when the exhaust gas sensor 105A and the vehicle-mounted engine control apparatus 100A are connected to each other and the power switch is first turned on. As a result, the control load of the microprocessor 120A immediately after the start of operation of the engine can be reduced.

In addition, in case where the exhaust gas sensor 105A or the vehicle-mounted engine control apparatus 100A is replaced with a new one, the label resistor 106 can be easily discriminated by interrupting the power switch 102 after the power switch 102 is once turned on.

In addition, as a fifth feature (corresponding to claim 10), the nonvolatile program memory 121A is further provided with a control program that constitutes a label resistor abnormality determination unit (steps 305, 325), a tentative information selection unit (steps 306*b*, 326*b*) and an abnormality occurrence information storage unit (step 327).

In case where the resistance value Rx of the label resistor 106 measured by the label resistor discrimination unit (steps 304, 324) is a value that deviates from the predetermined reference value Ri, the label resistor abnormality determination unit (steps 305, 325) makes a determination that the label resistor 106 is in an open-circuit/short-circuit abnormality.

When the open-circuit/short-circuit abnormality of the label resistor 106 is determined by the label resistor abnormality determination unit (steps 305, 325), the tentative information selection unit (steps 306*b*, 326*b*) is executed to select a reference factor that is capable of adjusting the correction factor K to a value of 1.0 (K=1.0) or to continuously use the correction factor K when there exists the correction factor K that has already been selected.

The abnormality occurrence information storage unit (step 327) transfers to and writes into the nonvolatile data memory 123 the fact that the label resistor abnormality determination unit (steps 305, 325) has determined the open-circuit/short-circuit abnormality of the label resistor 106.

Thus, since the nonvolatile program memory 121A is provided with the control program that constitutes the label resistor abnormality determination unit (steps 305, 325), the tentative information selection unit (steps 306*b*, 326*b*) and the abnormality occurrence information storage unit (step 327), when an open-circuit and short-circuit abnormality of the label resistor 106 occurs, a tentative correction factor is applied as the correction factor K to enable the continued operation of the vehicle-mounted engine control apparatus 100A, and maintenance and inspection can be performed based on abnormality occurrence information stored.

In addition, as a sixth feature (corresponding to claim 11), the nonvolatile program memory 121A is further provided with a control program which constitutes a regular abnormality determination unit (step 315) and an abnormality notification unit (step 317).

The regular abnormality determination unit (step 315) is periodically executed during the operation of the microprocessor 120A in which the closed state of the power switch 102 continues, and determines the presence or absence of a short-circuit/open-circuit abnormality of the label resistor 106 or the wiring thereof according to whether the resistance value Rx of the label resistor 106 is less than a predetermined lower limit value, or whether the resistance value Rx of the label resistor 106 is equal to or more than a predetermined upper limit value.

In addition, the abnormality notification unit (step 317) generates an abnormality notification command signal when the regular abnormality determination unit (step 315) determines an abnormal state. The abnormality notification unit saves and stores abnormality notification historical information into the nonvolatile data memory 123 immediately after the power switch 102 is interrupted.

Thus, since the nonvolatile program memory 121A is provided with the regular abnormality determination unit for the label resistor 106 (step 315) and the abnormality notification unit (step 317), in case where an abnormality occurs due to poor contact of a connector or the like caused by the vibration of the vehicle body during operation of the vehicle, even if an abnormality does not occur in the label resistor 106, such an abnormality can be detected in an easy and simple manner by using the label resistor discrimination unit (step 314) immediately after the power switch 102 is turned on or after the power switch 102 is interrupted, as a result of which it is possible to prompt or recommend maintenance and inspection.

In addition, as a seventh feature (corresponding to claim 12), when the order of the theoretical value of the label resistor 106 is changed, a measured potential at a junction between the label resistor 106 and the fixed resistor 116 input to the microprocessor 120A through the multichannel AD converter 124 becomes a series that changes as a geometric series with a predetermined ratio, and the actual resistance value of the label resistor 106 is selected from a preferred number series based on public standards.

As a result, when the actual order i of the label resistor 106 is changed, the measured potential changes at a ratio larger than the geometric series with the predetermined ratio.

In this manner, the label resistor 106 is selected from the preferred number series, and when the order i of the label resistor 106 is changed, the potential at the junction between the label resistor 106 and the fixed resistor 116 changes at a ratio larger than the predetermined ratio, so the order i of the label resistor 106 applied can be determined in an accurate manner even if there is a measurement error within a predetermined range in the voltage across the opposite ends of the label resistor 106.

In addition, as an eighth feature (corresponding to claim 13), the nonvolatile program memory 121A is further provided with a control program that constitutes an air fuel ratio calibration detection unit (step 319).

The air fuel ratio calibration detection unit (step 319) calculates a calibrated detection signal output Ipp (=K×Ip) by multiplying a detection signal output Ip corresponding to the air fuel ratio obtained by the exhaust gas sensor 105A by the correction factor K based on the order i of the label resistor 106 specified by the label resistor discrimination unit (steps 304, 324), and estimates the current air fuel ratio from the data table (or approximation equation) for the standard output characteristic 200 of the exhaust gas sensor 105A by using the calibrated detection signal output Ipp thus obtained.

Thus, since the correction factor K decided by the order i of the label resistor 106 specified by the label resistor discrimination unit (steps 304, 324) and the air fuel ratio calibrated by using the data of the standard output characteristic 200 of the exhaust gas sensor 105A are calculated, it is possible to measure an accurate air fuel ratio by calibrating the change in individual variation of the exhaust gas sensor 105A through simple arithmetic calculations without depending on hardware.

In addition, as a ninth feature (corresponding to claim 14), the detection signal output Ip obtained by the exhaust gas sensor 105A is a positive or negative current value, and a circuit for adding a current detection resistance Rs and a bias voltage Vg to each other is added to a circuit that generates the detection signal output Ip, so that a corrected input signal voltage Vin (=Ip×Rs+Vg), being always a positive value, is input to the multichannel AD converter 124.

In this case, the microprocessor 120A obtains a digital conversion value proportional to the detection signal output Ip by subtracting a digital conversion value corresponding to the bias voltage Vg from a digital conversion value of the corrected input signal voltage Vin, and dividing it by the value of the current detection resistance Rs.

In this manner, it is constructed such that the detection signal output Ip of the exhaust gas sensor 105A is input to the multichannel AD converter 124 as the corrected input signal voltage Ipp which is always a positive value, and the digital conversion value corresponding to the bias voltage added by the input circuit is subtracted from the digital conversion value of the corrected input signal voltage Vin, whereby the digital conversion value proportional to the detection signal output Ip is obtained.

Accordingly, the multichannel AD converter 124 does not handle both a positive and a negative input signal voltage, so a negative power supply is not needed, thereby making it possible to construct an inexpensive circuit structure.

Embodiment 2

Figure 5:
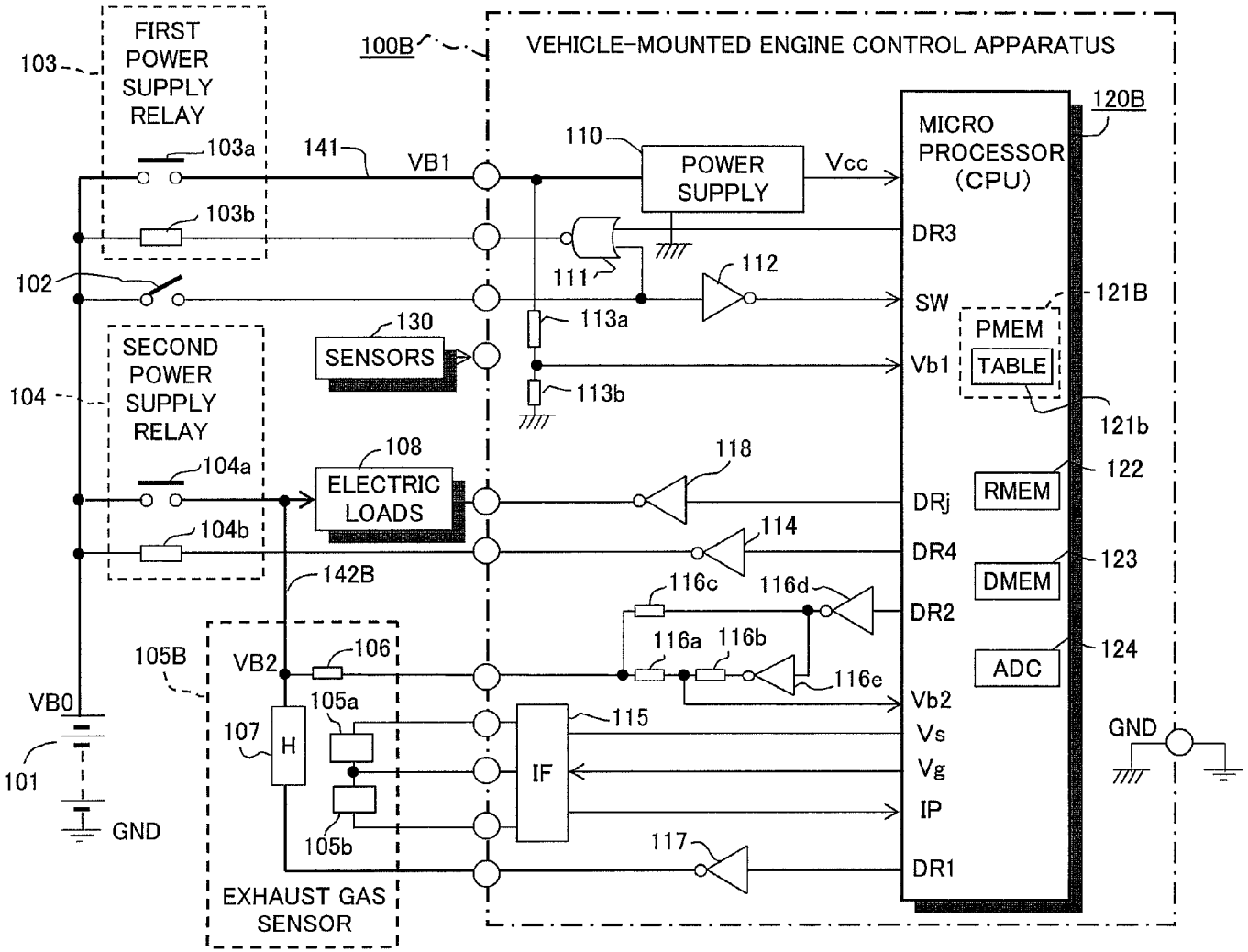
FIG. 5 is a block diagram showing the overall construction of a vehicle-mounted engine control apparatus according to a second embodiment of the present invention.

Although in the above-mentioned first embodiment (FIG. 1), the second power wire 142A for feeding electric power to the exhaust gas sensor 105A is connected to the first power supply relay 103, another second power wire 142B can instead be connected to a second power supply relay 104, as shown in FIG. 5.

FIG. 5 is a block diagram showing the overall construction of a vehicle-mounted engine control apparatus 100B according to a second embodiment of the present invention, and like parts or components as those described above (see FIG. 1) are identified by the same symbols or by the same symbols with "B" affixed to their ends, while omitting a detailed explanation thereof.

Hereinafter, reference will be made to the second embodiment of the present invention as shown in FIG. 5, mainly describing the differences thereof from the above-mentioned first embodiment (FIG. 1).

Here, note that in the construction of FIG. 5, too, an output characteristic of an exhaust gas sensor 105B is as shown in FIG. 2, and for conversion data of the exhaust gas sensor 105B, the data table of FIG. 4 is applied as it is.

In FIG. 5, the main differences thereof from FIG. 1 are only that the second power wire 142B for feeding power to the exhaust gas sensor 105B is connected to an output contact 104*a* of the second power supply relay 104, and in addition, a method of calculating a second power feed voltage VB2 according to this second embodiment is different from that of the first embodiment.

In this case, the vehicle-mounted engine control apparatus 100B is composed of a microprocessor (CPU) 120B as its main component, and is provided, as its internal configuration to cooperate with the microprocessor 120B, with a control power supply 110, a power supply relay driving circuit 111, a power supply turn-on monitoring circuit 112, voltage dividing resistors 113*a*, 113*b*, a drive element 114, a control circuit 115, a fixed resistor 116*c*, a switching element 117, and an electric load driving element 118, and it is further provided, in addition thereto, with voltage dividing resistors 116*a*, 116*b* and selective switching elements 116*d*, 116*e*.

The microprocessor 120B includes a nonvolatile program memory 121B, a RAM memory 122, a nonvolatile data memory 123, and a multichannel AD converter 124, all of which cooperate with one another. The nonvolatile program memory 121B is provided with conversion data 121*b*.

A power switch 102, a first power supply relay 103, the second power supply relay 104, electric loads 108, sensors 130, and the exhaust gas sensor 105B are connected to the vehicle-mounted engine control apparatus 100B, similarly as stated above.

In the vehicle-mounted engine control apparatus 100B, the voltage dividing resistors 116*a*, 116*b* of high resistance are connected in series to a negative terminal of a label resistor 106, and one of the resistors, 106*b*, is connected to a ground circuit GND when the output logic level of the selective switching element 116*e* becomes low ("L").

A junction between the voltage dividing resistors 116*a*, 116*b* is input to the microprocessor 120B as a second monitor voltage Vb2.

The fixed resistor 116*c* has one end thereof connected to the negative terminal of the label resistor 106, and the other end thereof connected to the ground circuit GND when the output logic level of the selective switching element 116*d* becomes low.

The selective switching element 116*d* generates an inverting logic output with respect to the logic level of a selection command signal DR2 that is generated by the microprocessor 120B.

The selective switching element 116*e* has an input terminal thereof connected to an output terminal of the selective switching element 116*d*, and generates an inverting logic output with respect to the output logic level of the selective switching element 116*d*.

In the above-mentioned construction, when the logic level of the selection command signal DR2 is low, the fixed resistor 116*c* is brought into a non-connected state, and instead, the voltage dividing resistors 116*a*, 116*b* are brought into a connected state.

Accordingly, assuming that the second monitor voltage Vb2 at the time when the logic level of the selection command signal DR2 becomes low is an opening voltage VL, the opening voltage VL is represented according to the following expression (10) by using the second power feed voltage VB2 (the positive terminal voltage of the label resistor 106), the resistance value Rx of the label resistor 106, and the resistance values R116*a*, R116*b* of the voltage dividing resistors 116*a*, 116*b*.

$$VL=VB2\times R116b/(Rx+R116a+R116b) \quad (10)$$

However, in expression (10) above, the values of the resistance values R116*a*, R116*b* are known or given values which are stored in the nonvolatile program memory 121B beforehand.

On the other hand, when the logic level of the selection command signal DR2 is high, the voltage dividing resistor 116*b* is brought into a non-connected state, and instead, the fixed resistor 116*c* is brought into a connected state.

Therefore, assuming that the value of the second monitor voltage Vb2 at the time when the logic level of the selection command signal DR2 becomes high is a closing voltage Vh, the closing voltage Vh is represented according to the following expression (11) by using the resistance value R0 of the fixed resistor 116*c*.

$$Vh=VB2\times R0/(Rx+R0) \quad (11)$$

Here, in expression (10) above, the value of the resistance value R0 is a known value that is stored in the nonvolatile program memory 121B beforehand.

Here, assuming that the second power feed voltage VB2 at the time when the logic level of the selection command signal DR2 is low, and the second power feed voltage VB2 at the time when the logic level of the selection command signal DR2 is high are the same value, the value of the second power feed voltage VB2 and the value of the resistance value Rx of the label resistor 106 can be calculated from the above-mentioned expressions (10) and (11).

When the resistance value Rx is calculated, the reference value Ri of the label resistor 106 or the order i of the label resistor 106 or the value of the correction factor K is fixedly decided from the data table of FIG. 4, similarly as stated above.

Hereinafter, reference will be made to the measurement operation of the label resistor 106 according to the second embodiment of the present invention, as illustrated in FIG. 5, while referring to flow charts of FIGS. 6 and 7.

First of all, in FIG. 5, when the power switch 102 is closed to energize the excitation coil 103*b* through the power supply relay driving circuit 111, the on-vehicle battery 101 is connected to the vehicle-mounted engine control apparatus 100B through the output contact 103*a* of the power supply relay 103, so that a drive voltage Vcc is applied to the microprocessor 120B through the control power supply 110.

The microprocessor 120B drives and controls the electric loads 108 (including at least a fuel injection electromagnetic valve) and an electric heater 107 in the exhaust gas sensor 105B in response to the operating state of the sensors 130 (including at least an intake air amount sensor for measuring or estimating the amount of intake air) and the operating state of the exhaust gas sensor 105B as well as the contents of the control programs in the nonvolatile program memory 121B.

However, the measurement operation of the label resistor 106 according to the flow chart of FIG. 6 is performed prior to these ordinary control operations.

On the other hand, when the power switch 102 is opened, the microprocessor 120B stops the self-hold command signal DR3 after executing a save operation in FIG. 6. As a result, the first power supply relay 103 is deenergized to open the output contact 103*a*, whereby the power feed to the vehicle-mounted engine control apparatus 100B is stopped.

In FIG. 6, the entire control flow (steps 500 through 529) is substantially identical to the control flow of FIG. 3 (steps 300 through 329).

However, only the contents of steps 504, 514, 524 in FIG. 6 (corresponding to steps 304, 314, 324 in FIG. 3) are different from the above-mentioned ones. Details of step 504, 514, 524 are shown in the flow chart of FIG. 7.

Figure 7:
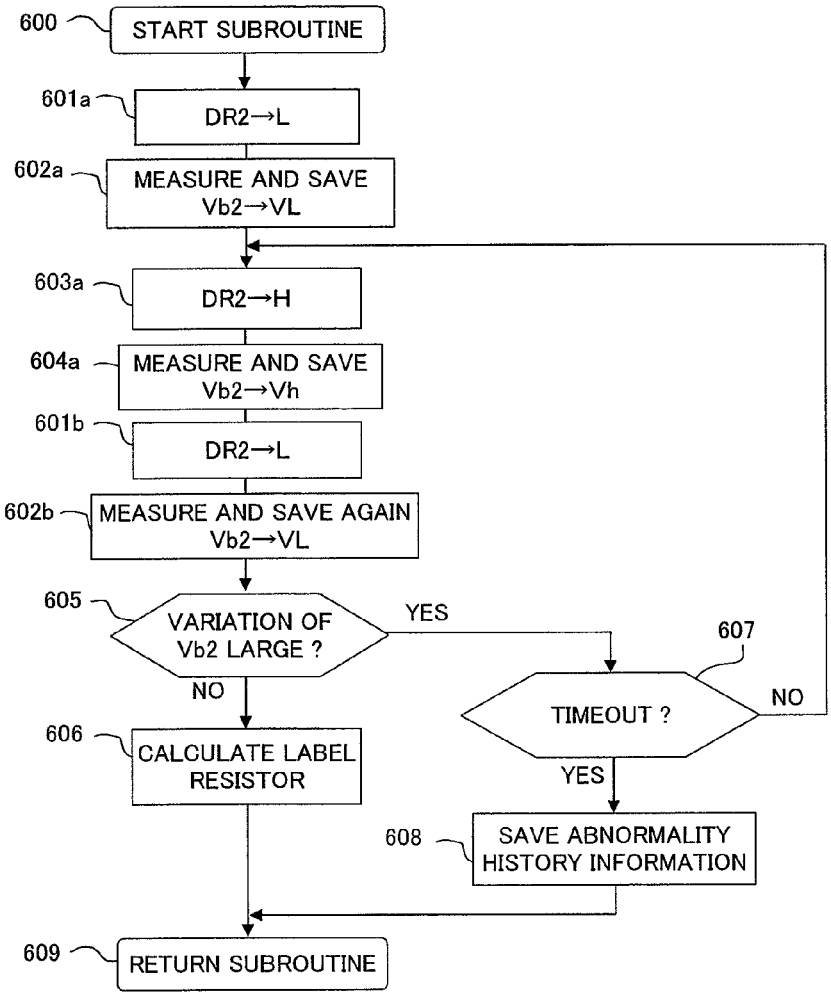
FIG. 7 is a flow chart explaining a part of the operation in FIG. 6 in a detailed manner.

In FIG. 7, first of all, step 600 is the start-up processing of a subroutine program, and this subroutine program is executed when the result of a determination in step 501*a* in FIG. 6 is "NO", or it is executed following the step 503*a* or 523 in FIG. 6.

Following step 600, the microprocessor 120B releases or opens a negative end of the fixed resistor 116*c* by setting the logic level of the selection command signal DR2 to be low, so that a negative end of the voltage dividing resistor 116*b* is connected to the ground circuit GND.

Then, the microprocessor 120B reads the value of the second monitor voltage Vb2 into the RAM memory 122 through the multichannel AD converter 124 (step 602*a*).

The value of the second monitor voltage Vb2 read in step 602*a* corresponds to the opening voltage VL represented by the above-mentioned expression (10).

Subsequently, the microprocessor 120B connects the negative end of the fixed resistor 116*c* to the ground circuit GND to release or open the negative end of the voltage dividing resistor 116*b* by setting the logic level of the selection command signal DR2 to be high (step 603*a*), and thereafter, reads the value of the second monitor voltage Vb2 into the RAM memory 122 through the multichannel AD converter 124 (step 604*a*).

The value of the second monitor voltage Vb2 read in step 604*a* corresponds to the closing voltage Vh represented by the above-mentioned expression (11).

Then, the microprocessor 120B releases or opens the negative end of the fixed resistor 116*c* to connect the negative end of the voltage dividing resistor 116*b* to the ground circuit GND by again setting the logic level of the selection command signal DR2 to be low (step 601*b*), and thereafter, reads the value of the second monitor voltage Vb2 into the RAM memory 122 through the multichannel AD converter 124 (step 602*a*).

The value of the second monitor voltage Vb2 read in step 602*a* corresponds to the opening voltage VL represented by the above-mentioned expression (10).

Next, the microprocessor 120B makes a determination as to whether the value read in step 602*b* and the value of the opening voltage VL read again in step 602*b* coincide with each other within a predetermined allowance error range (step 605). If the variation or difference between both of them is large, it is determined to be "YES", the flow shifts to step 607, whereas if the variation is small, it is determined to be "NO", and the flow shifts to step 606.

Here, note that if the variation of the second power feed voltage VB2 is small for a short time from the execution of the step 602*a* to the execution of the step 602*b*, the variation of the opening voltage VL represented by the above-mentioned expression (10) is generally small, too, so in step 605, it is determined to be "NO", and the flow shifts to step 606.

However, when the pulsation or noise variation of the second power feed voltage VB2 is generated for a short time from the execution of the step 602*a* to the execution of the step 602*b*, it can be determined to be "YES" in step 605, and the flow can shift to step 607.

In step 606, the resistance value Rx of the label resistor 106 is calculated by substituting the opening voltage VL read in step 602*a* or in step 602*b* (or an average value being used if there is a slight difference between the values thus read) and the value of the closing voltage Vh read in step 604*a* for those in the above expressions (10) and (11).

In step 607, the time elapsed after the step 607 begins to be executed is measured, and it is determined whether this elapsed time is within a predetermined time limit. If the elapsed time does not exceed the predetermined time limit, it is determined to be "NO", and a return is made to step 603*a*, whereas if the elapsed time exceeds the predetermined time limit, it is determined to be "YES", and the flow shifts to step 608.

Here, note that in case where the processing in steps 603*a* through 605 is again executed after it has been determined to be "NO" in step 607, the value of the opening voltage VL measured in the last step 602*b* and the value of the opening voltage VL measured in the current step 602*b* are compared with each other, whereby it is determined whether the variation or difference therebetween is large or small (step 605).

On the other hand, in step 608, a determination of time-out ("YES") made in step 607 is written into a fifth predetermined address of the RAM memory 122 as abnormality information.

Finally, in steps 606, 608, after a timer for the timing of the time-out activated in step 607 is reset, a shift is made to sub-return processing (step 609), and the subroutine of FIG. 7 is terminated.

Hereinafter, the flow shifts from step 609 in FIG. 7 to either of steps 505, 515 and 525 in FIG. 6.

Here, note that in FIG. 7, the step 602*a* corresponds to a positive terminal potential measurement unit, and the step 602*b* corresponds to a positive terminal potential verification unit, and the step 604*a* corresponds to a negative terminal potential measurement unit.

As described above, the vehicle-mounted engine control apparatus 100B according to the second embodiment of the present invention (FIG. 5 through FIG. 7) has, as a first feature (corresponding to claim 1), the following construction. That is, when the power switch 102 is turned on, in response to the operating state of the exhaust gas sensor 105B for measuring the air fuel ratio and the operating state of the sensors 130 (including at least an intake air amount sensor for measuring or estimating the amount of intake air) for monitoring or watching the operating state of the vehicle-mounted engine, the vehicle-mounted engine control apparatus 1008 is fed with electric power from the on-vehicle battery 101 through the first power wire 141 thereby to control the electric loads 108 for the driving of the engine (including a fuel injection electromagnetic valve).

The exhaust gas sensor 105B is provided with the label resistor 106 that becomes an index for selecting the correction factor K for the characteristic variation of the air fuel ratio measurement elements 105*a*, 105*b*, and the electric heater 107 that serves to raise the temperature of the exhaust gas sensor 105B to an activation temperature at an early time.

A positive terminal, to which one end of the label resistor 106 and one end of the electric heater 107 are connected, is connected to the on-vehicle battery 101 through the second power wire 142B. In addition, the negative end of the label resistor 106 and the negative end of the electric heater 107 are connected to the vehicle-mounted engine control apparatus 100B through individual wires, respectively.

As the resistance value Rx of the label resistor 106, there is selected and used, from among a series of numerical values, one which lies in a predetermined error range around one of the series of numerical values changing in multiple stages.

The vehicle-mounted engine control apparatus 100B is provided with the microprocessor 120B, the nonvolatile program memory 121B, the RAM memory 122, the nonvolatile data memory 123, and the multichannel AD converter 124, all of which cooperate with one another. The vehicle-mounted engine control apparatus 100B is further provided with positive end potential measurement circuits 116*a*, 116*b* for the label resistor 106, and a negative end potential measurement circuit that measures a voltage across the opposite ends of the known or given fixed resistor 116*c* connected in series to the negative end of the label resistor 106.

The nonvolatile program memory 121B is provided with a control program, which constitutes a label resistor discrimination unit (steps 804, 524), and the conversion data 121*b*.

The conversion data 121*b* includes the data table (or approximation equation) for the standard characteristic 200 (FIG. 2) of the detection signal output Ip versus the air fuel ratio A/F of the exhaust gas sensor 105B, and the data table (or approximation equation) for the value of the correction factor K corresponding to the discriminated label resistor 106.

In order to estimate the power feed voltage VB2 from the on-vehicle battery 101 applied to the positive terminal of the label resistor 106 based on the potential of the vehicle body to which the negative terminal of the on-vehicle battery 101 is connected, the positive end potential measurement circuit is composed of the voltage dividing resistors 116*a*, 116*b* that serve to divide the second power feed voltage VB2 fed from the second power wire 142B thereby to input it to the multichannel AD converter 124.

The negative end potential measurement circuit serves to input the voltage across the opposite ends of the fixed resistor 116*c* to the multichannel AD converter 124.

The label resistor discrimination unit (steps 504, 524) calculates a current supplied to the label resistor 106 by dividing the voltage across the opposite ends of the fixed resistor 116*c* input to the microprocessor 120B through the multichannel AD converter 124 by a known or given fixed resistance value. In addition, the label resistor discrimination unit calculates the resistance value Rx of the label resistor 106 by dividing the voltage across the opposite ends of the label resistor 106, which is obtained by subtracting the negative end potential of the label resistor 106 from the positive end potential thereof, by the current supplied to the label resistor 106, and specifies the label resistor of which order i stored as the conversion data 121*b* the calculated resistance value Rx is.

The microprocessor 120B controls the amount of injection fuel so as to obtain a predetermined air fuel ratio (A/F) in response to the value of the detection signal output Ip of the exhaust gas sensor 105B, the resistance value Rx of the label resistor 106, and the value of the conversion data 121*b*.

In addition, as a second feature (corresponding to claim 4), the positive end potential measurement circuit is composed of the voltage dividing resistors 116*a*, 116*b* of high resistance for dividing the second power feed voltage VB2 applied to the positive terminal of the label resistor 106 through the second power wire 142B to input it to the multichannel AD converter 124.

The negative end potential measurement circuit serves to make a connection of the fixed resistor 116*c* in response to the selection command signal DR2 of the microprocessor 120B. In addition, the negative end potential measurement circuit is composed of the selective switching elements 116*d*, 116*e* that open the downstream sides of the voltage dividing resistors 116*a*, 116*b* thereby to input the voltage across the opposite ends of the fixed resistor 116*c* to the same channel of the multichannel AD converter 124.

The label resistor discrimination unit (steps 504, 524) is provided with a positive terminal potential measurement unit (step 602*a*) that measures the positive end potential of the label resistor 106 with the fixed resistor 116*c* being not connected, and a negative terminal potential measurement unit (step 604*a*) that measures the voltage across the opposite ends of the fixed resistor 116*c* after the fixed resistor 116*c* has been connected.

In this manner, the positive end potential and the negative end potential of the label resistor 106 are input to the multichannel AD converter 124 through the same analog signal circuit, and are read in a time-sharing manner by means of the selection command signal DR2 from the microprocessor 120B. As a result, there is an advantageous effect that even if the first power feed voltage VB1 to the vehicle-mounted engine control apparatus 100B and the second power feed voltage VB2 to the exhaust gas sensor 105B are different from each other, the discrimination of the label resistor 106 can be made in an accurate manner, and moreover, the number of analog input channels is not increased.

In addition, as a third feature (corresponding to claim 5), the label resistor discrimination unit (steps 504, 524) is further provided with a positive terminal potential verification unit (step 602*b*).

The positive terminal potential verification unit (step 602*b*) verifies whether positive terminal potentials measured by the positive terminal potential verification unit (step 602*a*) and by the positive terminal potential verification unit (step 602*b*) before and after the measurement of the negative terminal potential of the label resistor 106 by the negative terminal potential measurement unit (step 604*a*) coincide with each other within a predetermined error tolerance.

In this manner, the label resistor discrimination unit (steps 504, 524) is further provided with the positive terminal potential verification unit (step 602*b*), and verifies whether the positive terminal potentials measured by the positive terminal potential measurement unit (step 602*a*) and the positive terminal potential verification unit (step 602*b*) coincide with each other before and after the measurement of the negative terminal potential of the label resistor 106. As a result, in case where the second power feed voltage VB2 to the exhaust gas sensor 105B obtained through the second power wire 142B has varied, it is possible to make an accurate determination by reexecuting the discrimination processing of the label resistor 106.

In addition, as a fourth feature (corresponding to claim 9), the nonvolatile program memory 121B is further provided with a control program which constitutes a determination saving and storing unit (step 526*a*) and a save verification unit (step 501*b*).

The determination storing and saving unit (step 526*a*) executes discrimination processing of the label resistor 106 by means of the label resistor discrimination unit (step 524) in a predetermined period in which the power feed to the vehicle-mounted engine control apparatus 100B is continued for a short time after the power switch 102 is opened, and saves and stores the reference value Ri of the label resistor 106 thus discriminated, or the order i of the reference value Ri, or the value of the correction factor K corresponding to the reference value Ri, into the nonvolatile data memory 123.

The save verification unit (step 501*b*) is executed, immediately after the power switch 102 is closed, to determine whether the discrimination result of the label resistor 106 has already been saved in the nonvolatile data memory 123 by means of the determination saving and storing unit (step 526*a*). If verified and stored, the discrimination result stored in the nonvolatile data memory 123 is read out and saved in the RAM memory 122, whereas if the discrimination result is not stored in the nonvolatile data memory 123, the label resistor discrimination unit (step 504) is executed, so that the discrimination result is written and saved into the RAM memory 122.

In addition, as a fifth feature (corresponding to claim 10), the nonvolatile program memory 121B is further provided with a control program that constitutes a label resistor abnormality determination unit (steps 505, 525), a tentative information selection unit (steps 506*b*, 526*b*) and an abnormality occurrence information storage unit (step 527).

In case where the resistance value Rx of the label resistor 106 measured by the label resistor discrimination unit (steps 504, 524) is a value that deviates from the predetermined reference value Ri, the label resistor abnormality determination unit (steps 505, 525) makes a determination that the label resistor 106 is in an open-circuit/short-circuit abnormality.

When the open-circuit/short-circuit abnormality of the label resistor 106 is determined by the label resistor abnormality determination unit (steps 505, 525), the tentative information selection unit (steps 506*b*, 526*b*) is executed to select a reference factor that is capable of adjusting the correction factor K to a value of 1.0 (K=1.0) or to continuously use the correction factor K when there exists the correction factor K that has already been selected.

The abnormality occurrence information storage unit (step 527) transfers to and writes into the nonvolatile data memory 123 the fact that the label resistor abnormality determination unit (steps 505, 525) has determined the open-circuit/short-circuit abnormality of the label resistor 106.

In addition, as a sixth feature (corresponding to claim 11), the nonvolatile program memory 121B is further provided with a control program which constitutes a regular abnormality determination unit (step 515) and an abnormality notification unit (step 517).

The regular abnormality determination unit (step 515) is periodically executed during the operation of the microprocessor 120B in which the closed state of the power switch 102 continues, and determines the presence or absence of a short-circuit/open-circuit abnormality of the label resistor 106 or the wiring thereof according to whether the resistance value Rx of the label resistor 106 is less than a predetermined lower limit value, or whether the resistance value Rx of the label resistor 106 is equal to or more than a predetermined upper limit value.

The abnormality notification unit (step 517) generates an abnormality notification command signal when the regular abnormality determination unit (step 515) determines an abnormal state. In addition, the abnormality notification unit saves and stores abnormality notification historical information into the nonvolatile data memory 123 immediately after the power switch 102 is interrupted.

In addition, as a seventh feature (corresponding to claim 12), when the order of the theoretical value of the label resistor 106 is changed, a measured potential at a junction between the label resistor 106 and the fixed resistor 116*c* input to the microprocessor 120B through the multichannel AD converter 124 becomes a series that changes as a geometric series with a predetermined ratio, and the actual resistance value of the label resistor 106 is selected from a preferred number series based on public standards.

Accordingly, when the actual order i of the label resistor 106 is changed, the measured potential changes at a ratio larger than the geometric series with the predetermined ratio.

In addition, as an eighth feature (corresponding to claim 13), the nonvolatile program memory 121B is further provided with a control program that constitutes an air fuel ratio calibration detection unit (step 519).

The air fuel ratio calibration detection unit (step 519) calculates a calibrated detection signal output Ipp (=K×Ip) by multiplying a detection signal output Ip corresponding to the air fuel ratio (A/F) obtained by the exhaust gas sensor 105B by the correction factor K based on the order i of the label resistor 106 specified by the label resistor discrimination unit (steps 504, 524), and estimates the current air fuel ratio from the data table (or approximation equation) for the standard output characteristic 200 (FIG. 2) of the exhaust gas sensor 105B by using the calibrated detection signal output Ipp thus obtained.

In addition, as a ninth feature (corresponding to claim 14), the detection signal output Ip obtained by the exhaust gas sensor 105B is a positive or negative current value, and a circuit for adding a current detection resistance Rs and a bias voltage Vg to each other is added to a circuit that generates the detection signal output Ip, so that a corrected input signal voltage Vin (=Ip×Rs+Vg), being always a positive value, is input to the multichannel AD converter 124.

In this case, the microprocessor 120B obtains a digital conversion value proportional to the detection signal output Ip by subtracting a digital conversion value corresponding to the bias voltage Vg from a digital conversion value of the corrected input signal voltage Vin, and dividing it by the value of the current detection resistance Rs.

Embodiment 3

In the above-mentioned second embodiment (FIG. 5), as a circuit structure related to the second power feed voltage VB2, there are provided, in addition to the label resistor 106, the selective switching elements 116*d*, 116*e* that respond to the selection command signal DR2, the voltage dividing resistors 116*a*, 116*b* connected to the selective switching element 116*e*, and the fixed resistor 116*c* connected to the selective switching element 116*d*. However, as shown in FIG. 8, a label resistor 109, voltage dividing resistors 119*a*, 119*b*, and a fixed resistor 119*c* can be provided at the side of a switching element 117 that responds to a switching command signal DR1, while omitting the label resistor 106 and the circuit components 116*a* through 116*e*.

Figure 8:
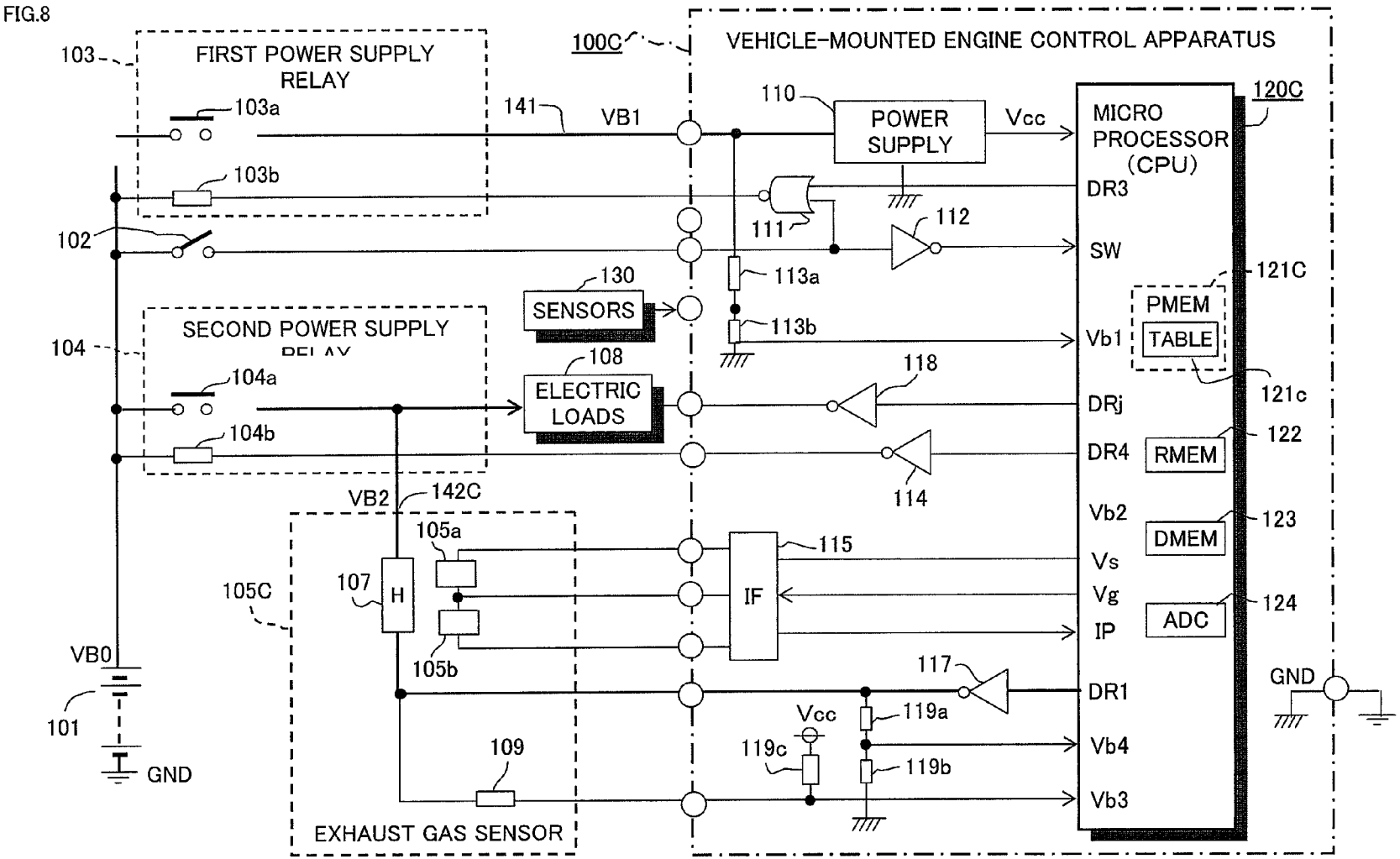
FIG. 8 is a block diagram showing the overall construction of a vehicle-mounted engine control apparatus according to a third embodiment of the present invention.

FIG. 8 is a block diagram illustrating the overall construction of a vehicle-mounted engine control apparatus 100C according to a third embodiment of the present invention, wherein the same parts or components as those described above (see FIG. 1 and FIG. 5) are identified by the same symbols or by the same symbols with "C" affixed to their ends, while omitting a detailed explanation thereof.

Hereinafter, reference will be made to the third embodiment of the present invention as shown in FIG. 5, mainly describing the differences thereof from the above-mentioned first embodiment (FIG. 1).

Here, note that in the third embodiment of the present invention, too, the output characteristic of an exhaust gas sensor 105C is as shown in FIG. 2. However, a data table of FIG. 9 is applied as conversion data of the exhaust gas sensor 105C in place of that of FIG. 4.

In FIG. 8, the main differences thereof from FIG. 1 are that a second power wire 142C for feeding power to the exhaust gas sensor 105C is connected to an output contact 104*a* of a second power supply relay 104, and in addition, a label resistor 109 is connected to a negative terminal of an electric heater 107.

In this case, the vehicle-mounted engine control apparatus 100C is composed of a microprocessor 120C as its main component, and the microprocessor 120C is provided, as its internal configuration to cooperate with the microprocessor 120C, with a control power supply 110, a power supply relay driving circuit 111, a power supply turn-on monitoring circuit 112, voltage dividing resistors 113*a*, 113*b*, a drive element 114, a control circuit 115, a switching element 117, and an electric load driving element 118, and it is further provided, in addition thereto, with voltage dividing resistors 119*a*, 119*b* and a fixed resistor 119*c*.

The microprocessor 120C includes a nonvolatile program memory 121C, a RAM memory 122, a nonvolatile data memory 123, and a multichannel AD converter 124, all of which cooperate with one another. The nonvolatile program memory 121C is provided with conversion data 121*c*.

A power switch 102, a first power supply relay 103, the second power supply relay 104, electric loads 108, sensors 130, and the exhaust gas sensor 105C are connected to the vehicle-mounted engine control apparatus 100C, similarly as stated above.

A drive voltage Vcc is applied to one end of the fixed resistor 119*c* in the vehicle-mounted engine control apparatus 100C, and the other end of the fixed resistor 119*c* is connected to a positive terminal of the label resistor 109.

In addition, a voltage at a junction between the fixed resistor 119*c* and the label resistor 109 is input to the microprocessor 120C as a divided voltage Vb3.

The voltage dividing resistors 119*a*, 119*b* having high resistance values are connected in series to a negative terminal of the electric heater 107, and a voltage at a junction between the voltage dividing resistor 119*a* and the voltage dividing resistor 119*b* is input to the microprocessor 120C as a closing divided voltage Vb4.

Accordingly, denotes the closing divided voltage Vb4 at the time when the logic level of the switching command signal DR1 becomes high to close the switching element 117 is represented according the following expression (12) by using a closing voltage Von of the switching element 117 and the individual resistance values R119*a*, R119*b* of the voltage dividing resistors 119*a*, 119*b*.

$$Vb4=Von\times R119b/(R119a+R119b) \quad (12)$$

Here, note that the individual resistance values R119*a*, R119*b* are known or given values that are stored in the nonvolatile program memory 121C beforehand.

Accordingly, the closing voltage Von can be calculated with the use of expression (12) above by measuring the closing divided voltage Vb4.

In addition, the divided voltage Vb3 at the time when the logic level of the switching command signal DR1 becomes high to close the switching element 117 is represented according to the following expression (13) by using the resistance value Rx of the label resistor 109 and the resistance value R0 of the fixed resistor 119*c*.

$$Vb3=(Vcc-Von)\times Rx/(R0+Rx)+Von \quad (13)$$

Here, in expression (13) above, the resistance value R0 of the fixed resistor 119*c* is stored in the nonvolatile program memory 121C beforehand.

Accordingly, using expression (13) above, the resistance value Rx of the label resistor 109 can be calculated from a measured value of the divided voltage Vb3 and the value of the closing voltage Von which is calculated by using the above-mentioned expression (12).

Here, as a specific example, assuming that R0=100 KΩ, Vcc=5 V, and Von=0.5 V, the following expression (14) is obtained from expression (13).

$$Vb3=4.5/(1+100/Rx)+0.5 \quad (14)$$

In addition, assuming that the divided voltage Vb3 is increased at a ratio or magnification λ of 1.1 (λ=1.1) (geometric progression) when the resistance value Rx of the label resistor 109 ranks up from reference value Ri to reference value $R_{i+1}$, the following expression (15) is obtained from expression (14) above.

$$1.1\times[4.5/(1+100/Ri)+0.5]=4.5/(1+100/R_{i+1})+0.5 \quad (15)$$

Further, by organizing expression (15) above, the following expression (16) is obtained.

$$R_{i+1}=100\times(1+1/Ri)/(90/Ri-0.1) \quad (16)$$

FIG. 9 is an explanatory view showing a conversion data table of the exhaust gas sensor 105C according to the third embodiment of the present invention, wherein the results of sequentially calculating reference values R2, R3, . . . , with the first term R1 being set to 1.1 KΩ are shown.

In FIG. 9, the reference value Ri actually applied is based on a preferred number series E24 that is a public standard, similarly as stated above. Also, a determination lower limit value Rmin is 95% of reference value $R_{i-1}$, and a determination upper limit value Rmax is 105% of the reference value Ri.

When it is discriminated that the label resistor of which order i in FIG. 9 the resistance value Rx of the label resistor 109 calculated by using expression (14) is, the correction factor K is specified according to the conversion data table of FIG. 9.

For example, if the resistance value Rx of the label resistor 109 is less than 1.04 KΩ, it is determined that the label resistor 109 is in a short-circuit abnormality (or a ground fault in which positive terminal wiring is in mixed contact with a ground circuit), and the correction factor is set to K=1.0 (or is kept as it is).

On the other hand, if the resistance value Rx of the label resistor 109 is less than 651 KΩ, it is determined that the label resistor 109 is in an open-circuit abnormality (or a power supply fault in which the positive terminal wiring is in mixed contact with the power wire), and the correction factor is set to K=1.0 (or is kept as it is).

Here, note that in FIG. 8, the drive voltage Vcc in the form of a constant voltage is applied to a series circuit comprising the fixed resistor 119*c* and the label resistor 109, so in place of the above-mentioned geometric progression, there can be adopted an arithmetical progression in which when the resistance value Rx of the label resistor 109 ranks up from the reference value Ri to reference value $R_{i+1}$, the divided voltage Vb3 is increased by a constant increment ΔV.

Hereinafter, reference will be made to the measurement operation of the label resistor 109 according to the third embodiment of the present invention, as illustrated in FIG. 8, while referring to the explanatory views of FIG. 2 and FIG. 9 as well as a flow chart of FIG. 10.

First of all, in FIG. 8, when the power switch 102 is closed to energize the excitation coil 103*b* through the power supply relay driving circuit 111, the on-vehicle battery 101 is connected to the vehicle-mounted engine control apparatus 100C through the output contact 103*a* of the power supply relay 103, similarly as stated above, so that a drive voltage Vcc is applied to the microprocessor 120C through the control power supply 110.

The microprocessor 120C drives and controls the electric loads 108 (including at least a fuel injection electromagnetic valve) and the electric heater 107 in the exhaust gas sensor 105C in response to the operating state of the sensors 130 (including at least an intake air amount sensor for measuring or estimating the amount of intake air) and the operating state of the exhaust gas sensor 105C as well as the contents of the control programs in the nonvolatile program memory 121C.

However, the measurement operation of the label resistor 109 according to the flow chart of FIG. 10 is performed prior to these ordinary control operations.

On the other hand, when the power switch 102 is opened, the microprocessor 120C stops the self-hold command signal DR3 after executing a save operation in FIG. 10. As a result, the first power supply relay 103 is deenergized to open the output contact 103*a*, whereby the power feed to the vehicle-mounted engine control apparatus 100C is stopped.

In FIG. 10, first of all, the microprocessor 120C starts the measurement operation of the label resistor 109 (step 800), and makes a determination as to whether the power switch 102 has changed from an open state (OFF) into a closed state (ON), by monitoring a power supply turn-on monitoring signal SW from the power supply turn-on monitoring circuit 112 (step 801).

In step 801, if it is detected that the power switch 102 has changed from the open state into the closed state (immediately after the closing of the power switch 102), a positive determination of "YES" is made, and the flow shifts to step 802, whereas when the power switch 102 has already been closed and is in a continuously closed operation, a negative determination of "NO" is made, and the flow shifts to step 813*a*.

In step 802, the logic level of the self-hold command signal DR3 to energize the excitation coil 103*b* of the first power supply relay 103 in its self-hold state is set to a high level ("H").

Subsequently, the logic level of switching command signal DR1 is set to a high level, whereby the switching element 117 is forcedly driven to close. In addition, preferably, the logic level of the command signal DR4 is set to a low level ("L"), whereby the energization of the second power supply relay 104 is inhibited (step 803*a*).

Then, the values of the divided voltage Vb3 and the closing divided voltage Vb4 are read into the RAM memory 122, so that the reading and determination of the label resistor 109 is performed (step 804).

In step 804, if the closing voltage Von of the switching element 117 is stored in the nonvolatile program memory 121C as a substantially constant fixed value beforehand, the reading of the closing divided voltage Vb4 and the calculation of the closing voltage Von according to the above-mentioned expression (12) are unnecessary.

In step 804, the microprocessor 120C calculates the resistance value Rx of the label resistor 109 based on the above-mentioned expression (14), searches for a reference value Ri of which order i in FIG. 4 the resistance value Rx thus calculated is close to, and specifies a correction factor K to be applied.

Subsequently, it is determined whether the value of the resistance value Rx of the label resistor 109 is abnormal (excessively large or small) (i.e., in a normal range) (step 805), and if abnormal, a positive determination of "YES" is made, and the flow shifts to step 806*b*, whereas if normal, a negative determination of "NO" is made, and the flow shifts to step 806*a*.

In step 806*a*, the correction factor K based on the order i of the label resistor 109 determined in step 804 is written into a first predetermined address of the RAM memory 122.

On the other hand, in step 806*b*, if there is an existing storage value (a value that is saved and stored in step 826 to be described) exists as the correction factor K, the value is kept, whereas if there is no saved and stored value, a reference value of K=1.00 is selected and written into the first predetermined address of the RAM memory 122.

In step 807 following step 806*b*, it is identified whether the abnormality of the label resistor 109 determined in step 805 is a short-circuit/ground fault abnormality of the label resistor 109, or an open-circuit/power supply fault abnormality thereof, and abnormality information, i.e., the result of this identification, is written into a second predetermined address of the RAM memory 122.

Following the step 806*a* or step 807, in step 803*b*, the energization inhibition state of the second power supply relay 104 according to step 803*a* is released. Then, the forced conductive state of the switching element 117 is released, and a shift is made to step 821 (to be described later).

On the other hand, in step 813*a* which is executed at the time when a negative determination of "NO" is made in step 801, similar to step 803*a*, the logic level of the switching command signal DR1 is set to a high level, whereby the switching element 117 is forcedly driven to close.

Here, note that the step 813*a* is executed in a repeated manner during the continuous operation of the microprocessor 120C, and at this time, the logic level of the command signal DR4 is kept high, and the second power supply relay 104 is continuously kept in the state of energization.

In step 814 following step 813*a*, the resistance value Rx of the label resistor 109 is calculated and the order i thereof is determined, similar to step 304. Here, note that in step 814, even if a different order i is obtained, the correction factor K is not changed.

Subsequently, the forced driving state of the switching element 117 according to step 813*a* is released.

After this, a shift is made to a control mode for controlling the environmental temperature of the exhaust gas sensor 105C according to an unillustrated control flow.

Then, similar to the step 805, it is determined whether there is an abnormality in the label resistor 106 (step 815), and if there is an abnormality, a positive determination of "YES" is made, and the flow shifts to step 817, whereas if there is no normality, a negative determination of "NO" is made, and the flow shifts to step 819 without executing the step 817.

In step 817, similar to step 807, the abnormality information of the label resistor 109 determined in step 815 is written into a third predetermined address of the RAM memory 122, and at the same time, an abnormality notification command signal is generated to operate an alarm display device (not shown).

In step 819 following step 817, the digital value of a bias addition is subtracted from the digital conversion value of a corrected input signal voltage Vin (=Vg+Ip×Rs) input to the multichannel AD converter 124 in response to a detection signal output Ip of the exhaust gas sensor 105C, and a positive or negative value (pump current Ip) obtained by dividing the digital conversion value thus subtracted by the value of the current detection resistance Rs is calculated.

In addition, in step 819, a calibrated pump current Ipp (=K×Ip) is obtained by multiplying the pump current Ip by the correction factor K written into the first predetermined address of the RAM memory 122 in step 806*a* or step 806*b*, and an air fuel ratio (A/F) is calculated from the data table corresponding to the standard output characteristic 200 in FIG. 2.

Here, note that the data table of FIG. 2 is stored in the nonvolatile program memory 121C beforehand.

In step 821 that is executed following the step 803*b* or 819, it is determined whether the power switch 102 has been opened, and if opened, a positive determination of "YES" is made, and the flow shifts to step 823, whereas if not opened, a negative determination of "NO" is made, and the flow shifts to an operation ending step 822.

Here, note that in step 822, the microprocessor 120C executes other control programs, and returns to the operation starting step 800 again by a predetermined time, after which the control flow in step 801 and onward is executed in a repeated manner.

In step 826, the correction factor K based on the order i of the label resistor 109 determined in step 806*a* or step 806*b* is written and saved in the first predetermined address of the nonvolatile data memory 123.

Thereafter, the abnormality historical information written in the second and third predetermined addresses of the RAM memory 122 in steps 807, 817 is accumulatively added to and saved into the second and third predetermined addresses of the nonvolatile data memory 123 (step 827).

In addition, the self-hold command signal DR3 is stopped to deenergize the excitation coil 103*b* of the first power supply relay 103 (step 828), and finally, electric power supplied to the vehicle-mounted engine control apparatus 100C is stopped (step 829), thereby terminating the processing routine of FIG. 10.

To summarize the above-mentioned control flow (FIG. 10), a series of processing in steps 802 through 803*b* are executed immediately after the power switch 102 is closed. The step 804 corresponds to a label resistor discrimination unit, and the step 805 corresponds to a label resistor abnormality determination unit, and the step 806*b* corresponds to a tentative information selection unit.

Moreover, a series of processing in steps 801 through 819 are executed in a repeated manner when the power switch 102 is continuously turned on. The step 815 corresponds to a regular abnormality determination unit, and the step 817 corresponds to an abnormality notification unit, and the step 819 corresponds to an air fuel ratio calibration detection unit.

Further, a series of processing in steps 826 through 829 are executed after the power switch 102 having been turned on is opened. The step 826 corresponds to a determination saving and storing unit, and the step 827 corresponds to an abnormality occurrence information storage unit.

In the third embodiment of the present invention, the determination processing of the label resistor 109 is executed in step 804 at the start of operation, so the label sensor 109 is discriminated when the power supply is turned on for the first time after the vehicle-mounted engine control apparatus 100C and the exhaust gas sensor 105C are connected to each other.

Or, in case where the exhaust gas sensor 105C or the vehicle-mounted engine control apparatus 100C is replaced with a new one for the purpose of maintenance, the label resistor 109 of the new exhaust gas sensor 105C freshly connected is discriminated immediately after the power switch 102 has been turned on.

The value of the correction factor K based on the label resistor 109 thus discriminated written and saved into the nonvolatile data memory 123 according to step 826 at the time when the power switch 102 is opened, and when the result of the determination in step 805 indicates the presence of an abnormality at the start of operation, the data thus saved comes to be used as a tentative factor according to step 806*b*.

In FIG. 8, the output contact 103*a* of the first power supply relay 103 feeds electric power to the vehicle-mounted engine control apparatus 100C, and the output contact 104*a* of the second power supply relay 104 feeds electric power to the electric loads 108 and the exhaust gas sensor 105C, but other circuit structures can be employed.

For example, electric power can be fed from the output contact 103*a* to a part of the electric loads 108 and the exhaust gas sensor 105C, or electric power can be fed from the power switch 102 to another part of the electric loads 108, or a power supply relay (not shown) can be added for those of the electric loads in which the vehicle-mounted engine control apparatus 100C is not involved.

In addition, the second power wire 142C for feeding electric power to the exhaust gas sensor 105C can be connected to the power switch 102, without being connected to the output contact 103*a* or the output contact 104*a*.

If the second power wire 142C for feeding electric power to the exhaust gas sensor 105C is connected to the output contact 103*a* or the power switch 102, when the switching element 117 is forced to be driven upon execution of the label resistor discrimination unit (steps 804, 814), the current fed to the electric heater 107 flows to the switching element 117, and hence the closing voltage Von of the switching element 117 becomes a value that can not be ignored, and besides, the closing voltage Von will vary because the current fed to the electric heater 107 also changes based on the temperature variation of the electric heater 107.

The closing divided voltage Vb4 is used as a supervisory or monitor signal to measure the varying closing voltage Von.

However, as shown in FIG. 8, in case where the second power wire 142C for feeding electric power to the exhaust gas sensor 105C is connected to the output contact 104*a*, by deenergizing the second power supply relay 104 upon execution of the label resistor discrimination unit (step 804), the current fed to the electric heater 107 does not flow to the switching element 117 even if the switching element 117 is forced to be driven, so the closing voltage Von of the switching element 117 becomes a substantially constant minute value. As a result, the closing divided voltage Vb4 (supervisory or monitor signal) input to the microprocessor 120C can be omitted.

In addition, according to the operation of FIG. 10, the discrimination of the label resistor 109 is performed in step 804 at the start of operation, but this can be done at the instant when the power switch 102 is opened, except at the time of the first discrimination, as stated above (FIG. 3 and FIG. 6).

FIG. 11 is a flow chart illustrating another measurement operation according to the third embodiment of the present invention, wherein steps 900, 901*a*, 902 through 922, and 927 through 929 are processes similar to those in the above-mentioned steps 800, 801, 802 through 822, and 827 through 829 (see FIG. 10).

In addition, steps 901*b*, 906*c*, and 924-926*b* are processes similar to those in the above-mentioned steps 301*b*, 306*c*, and 324 through 326*b* (see FIG. 3).

Hereinafter, reference will be made to the differences of FIG. 11 from FIG. 10.

In this case, a control program of FIG. 11 is stored in the nonvolatile program memory 121C in FIG. 8 in place of the control program of FIG. 10.

First of all, following step 900, by monitoring the power supply turn-on monitoring signal SW, it is determined whether the power switch 102 has changed from its open state into its closed state (step 901*a*). Immediately after the closing of the power switch 102, a positive determination of "YES" is made, and the flow shifts to step 901*b*, whereas when the power switch 102 has already been closed and is in a continuously closed operation, a negative determination of "NO" is made, and the flow shifts to step 913*a*.

In step 901*b*, it is verified whether the determination result of the label resistor 109 is saved in the nonvolatile data memory 123 in step 926*a* to be described later, and if the determination (save) has already been made, a positive determination of "YES" is made, and the flow shifts to step 906*c*, whereas if the determination has not yet been made, a determination of "NO" is made, and the flow shifts to step 902.

In step 906*c*, the value of the correction factor K to be written and saved into the first predetermined address of the nonvolatile data memory 123 in step 926*a* to be described later is transferred to and written into the first predetermined address of the RAM memory 122, and the flow then shifts to step 921.

In step 923 which is executed at the time when a positive determination of "YES" is made in step 921, similar to step 903*a* (step 803*a* in FIG. 10), the logic level of the switching command signal DR1 is set to a high level, whereby the switching element 117 is forcedly driven to close. Then, the logic level of the command signal DR4 is set to a low level, whereby the energization of the second power supply relay 104 is inhibited.

Subsequently, in step 924, the resistance value Rx of the label resistor 109 is calculated and the order i thereof is determined, similar to step 904 (step 804 in FIG. 10).

Then, in step 925, similar to step 905 (step 805 in FIG. 10), it is determined whether there is an abnormality in the label resistor 109, and if there is an abnormality, a positive determination of "YES" is made, and the flow shifts to step 926*b*, whereas if there is no normality, a negative determination of "NO" is made, and the flow shifts to step 926*a*.

In step 926*a*, the correction factor K based on the order i of the label resistor 109 determined in step 924 is written and saved into the first predetermined address of the nonvolatile data memory 123.

In step 926*b*, a reference value of K=1.00 is selected as the correction factor K, and is written and saved into the first predetermined address of the nonvolatile data memory 123, or in case where the correction factor K has already been stored in the first predetermined address of the nonvolatile data memory 123, the correction factor K having been saved is kept unchanged.

To summarize the above-mentioned control flow (FIG. 11), a series of processing in steps 923 through 929 are executed after the power switch 102 having been turned on is opened. The step 924 corresponds to a label resistor discrimination unit, and the step 925 corresponds to a label resistor abnormality determination unit. The step 926*a* corresponds to a determination saving and storing unit, and the step 926*b* corresponds to a tentative information selection unit, and the step 927 corresponds to an abnormality occurrence information storage unit.

In addition, a series of processing in steps 901*b* through 903*b* are executed immediately after the power switch 102 is closed. The step 901*b* corresponds to a save verification unit, and the step 904 corresponds to a label resistor discrimination unit. The step 905 corresponds to a label resistor abnormality determination unit, and the step 906*b* corresponds to a tentative information selection unit.

Moreover, a series of processing in steps 901*a* through 919 are executed in a repeated manner when the power switch 102 is continuously turned on. The step 915 corresponds to a regular abnormality determination unit, and the step 917 corresponds to an abnormality notification unit, and the step 919 corresponds to an air fuel ratio calibration detection unit.

Here, note that according to the control flow of FIG. 11, when the determination result of the label resistor is once saved and stored according to step 926*a*, it becomes unnecessary to do the discriminating operation of the label resistor according to step 904, so the control load of the microprocessor 120C at the time of engine starting comes to be reduced.

As described above, the vehicle-mounted engine control apparatus 100C according to the third embodiment of the present invention (FIG. 8 through FIG. 11) has, as a first feature (corresponding to claim 6), the following construction. That is, when the power switch 102 is turned on, in response to the operating state of the exhaust gas sensor 105C for measuring the air fuel ratio and the operating state of the sensors 130 (including at least an intake air amount sensor for measuring or estimating the amount of intake air) for monitoring or watching the operating state of the vehicle-mounted engine, the vehicle-mounted engine control apparatus 100C is fed with electric power from the on-vehicle battery 101 through the first power wire 141 thereby to control the electric loads 108 for the driving of the engine (including a fuel injection electromagnetic valve).

The exhaust gas sensor 105C is provided with the label resistor 109 that becomes an index for selecting the correction factor K for the characteristic variation of the air fuel ratio measurement elements 105*a*, 105*b*, and the electric heater 107 that serves to raise the temperature of the exhaust gas sensor 105C to an activation temperature at an early time.

The electric heater 107 has a positive terminal connected to the on-vehicle battery 101 through the second power wire 142C, and a negative end connected to the vehicle-mounted engine control apparatus 100C through heater wiring.

The label resistor 109 has a negative terminal connected to the negative terminal of the electric heater 107, and a positive terminal connected to the vehicle-mounted engine control apparatus 100C through individual signal wires. As the resistance value Rx of the label resistor 109, there is selected and used, from among a series of numerical values, one which lies in a predetermined error range around one of the series of numerical values changing in multiple stages.

The vehicle-mounted engine control apparatus 100C is provided with the microprocessor 120C, the nonvolatile program memory 121C, the RAM memory 122, the nonvolatile data memory 123, and the multichannel AD converter 124, all of which cooperate with one another.

Further, the vehicle-mounted engine control apparatus 100C is provided with the fixed resistor 119*c* of a known resistance value which is connected in series to the positive terminal of the label resistor 109 and to which the drive voltage Vcc is applied, the divided voltage measurement circuit that serves to input a potential at the junction between the label resistor 109 and the fixed resistor 119*c* to the multichannel AD converter 124, and the switching element 117 that is operated by the switching command signal DR1 from the microprocessor 120C to connect the negative terminal of the electric heater 107 to the ground circuit GND thereby to feed electric power to the electric heater 107.

The nonvolatile program memory 121C is provided with a control program, which constitutes a label resistor discrimination unit (steps 804, 904, 924), and the conversion data 121*c* that includes the data table (or approximation equation) for the standard characteristic 200 of the detection signal output Ip versus air fuel ratio A/F of the exhaust gas sensor 105C, and the data table (or approximation equation) for the value of the correction factor K corresponding to the resistance value of the discriminated label resistor 109.

When the switching element 117 is forcedly closed to cause the logic level of the negative terminal of the label resistor 109 to become a low voltage level, the label resistor discrimination unit (steps 804, 904, 924) calculates the resistance value Rx of the label resistor 109 from the value of the divided voltage Vb3 input to the multichannel AD converter 124 and the value of the drive voltage Vcc applied to the known or given fixed resistor 119*c*, and specifies the label resistor of which order i stored as the conversion data 121*a* the calculated resistance value Rx is.

The microprocessor 120C controls the amount of injection fuel so as to obtain a predetermined air fuel ratio (A/F) in response to the value of the detection signal output Ip of the exhaust gas sensor 105C, the resistance value Rx of the label resistor 109, and the value of the conversion data 121*c*.

In this manner, in the vehicle-mounted engine control apparatus 100C that controls the amount of injection fuel in response to the detection signal output Ip of the air fuel ratio by the exhaust gas sensor 105C, the correction factor K for correcting the change in individual variation of the detection signal output Ip of the exhaust gas sensor 105C is selected by the resistance value Rx of the label resistor 109 attached to the exhaust gas sensor 105C, and besides, one end of the label resistor 109 is connected to the negative terminal of the electric heater 107.

Accordingly, the output characteristic of the individual exhaust gas sensor 105C is corrected in an accurate manner by means of the correction factor K thus selected, and at the same time, the number of pins of a connector and the number of wires of the exhaust gas sensor 105C can be reduced or suppressed.

In addition, the resistance value Rx of the label resistor 109 is calculated by using the known or given fixed resistor 119*c* and the divided voltage value of the drive voltage applied to the label resistor 109, and at the same time, as the resistance value Rx of the label resistor 109, there is selected and used one which lies in a predetermined error range around one of the series of numerical values of multiple stages.

Accordingly, even if the resistance value Rx of the label resistor 109 is changed according to the environmental temperature, or even if a voltage variation of the power wire is generated, it is possible to specify the correction factor K to be applied in an accurate manner as long as such a change or variation is within a predetermined variation range.

In addition, as a second feature (corresponding to claim 7), the output voltage of the switching element 117 is input to the multichannel AD converter 124 through the voltage dividing resistors 119*a*, 119*b*, so that the voltage level of the switching element 117 at the time when the switching element 117 is forcedly closed to cause the logic level of the negative terminal of the label resistor 109 to become a low voltage level is measured by the closing divided voltage Vb4 of the voltage dividing resistors 119*a*, 119*b*.

The label resistor discrimination unit (steps 804, 904, 924) calculates the closing voltage of the switching element 117 calculated from the closing divided voltage Vb4, subtracts a voltage proportional to the closing voltage of the switching element 117 from the value of the divided voltage Vb3 due to the fixed resistor 119*c* and the label resistor 109, calculates the resistance value Rx of the label resistor 109 from the value of the drive voltage Vcc applied to the known or given fixed resistor 119*c*, and specifies the label resistor 109 of which order i stored as the conversion data 121*a* the calculated resistance value Rx is.

Thus, since the label resistor discrimination unit (steps 804, 904, 924) is further provided with a means or function that measures the closing voltage of the switching element 117 for driving the electric heater 107, it is possible to measure the label resistor 109 in an accurate manner by using the closing voltage of the switching element 117.

Moreover, as a third feature of the third embodiment (corresponding to claim 8), the exhaust gas sensor 105C is fed with electric power from the on-vehicle battery 101 through the output contact 104*a* of the second power supply relay 104, and the label resistor discrimination unit (steps 804, 904, 924) is executed with the second power supply relay 104 being deenergized.

Thus, since the label resistor discrimination unit (steps 804, 904, 924) is executed with the second power supply relay 104 for feeding power to the exhaust gas sensor 105C being deenergized, heater current does not flow to the electric heater 107 and the heater wiring when the switching element 117 is closed.

Accordingly, no voltage drop in the heater wiring is generated, and hence the resistance value Rx of the label resistor 19 can be measured with a high degree of precision.

Further, as a fourth feature of the third embodiment (corresponding to claim 9), the nonvolatile program memory 121C is further provided with a control program which constitutes a determination saving and storing unit (step 926*a*) and a save verification unit (step 901*b*).

The determination saving and storing unit (step 926*a*) discriminates the label resistor 109 by means of the label resistor discrimination unit (step 924) in a predetermined period in which the power feed to the vehicle-mounted engine control apparatus 100C is continued for a short time after the power switch 102 is opened, and saves and stores the reference value Ri of the label resistor 109 thus discriminated, or the order i of the reference value Ri, or the value of the correction factor K corresponding to the reference value Ri, into the nonvolatile data memory 123.

The save verification unit (step 901*b*) is executed immediately after the power switch 102 is closed, and determines whether the discrimination result of the label resistor 109 has already been saved in the nonvolatile data memory 123 by means of the determination saving and storing unit (step 926*a*). If verified and stored, the discrimination result stored in the nonvolatile data memory 123 is read out and saved into the RAM memory 122, whereas if the discrimination result is not stored in the nonvolatile data memory 123, the label resistor discrimination unit (step 904) is executed so that the discrimination result is written and saved into the RAM memory 122.

In addition, as a fifth feature of the third embodiment (corresponding to claim 10), the nonvolatile program memory 121C is further provided with a control program that constitutes a label resistor abnormality determination unit (steps 805, 905, 925), a tentative information selection unit (steps 806*b*, 906*b*, 926*b*) and an abnormality occurrence information storage unit (steps 827, 927).

In case where the resistance value Rx of the label resistor 109 measured by the label resistor discrimination unit (steps 804, 904, 924) is a value that deviates from the predetermined reference value Ri, the label resistor abnormality determination unit (steps 805, 905, 925) makes a determination that the label resistor 109 is in an open circuit/short-circuit abnormality.

When the open-circuit/short-circuit abnormality of the label resistor 109 is determined by the label resistor abnormality determination unit (steps 805, 905, 925), the tentative information selection unit (steps 806*b*, 906, 926*b*) is executed to select a reference factor that is capable of adjusting the correction factor K to a value of 1.0 (K=1.0) or to continuously use the correction factor K when there exists the correction factor K that has already been selected.

The abnormality occurrence information storage unit (steps 827, 927) transfers to and writes into the nonvolatile data memory 123 the fact that the label resistor abnormality determination unit (steps 805, 905, 925) has determined the open-circuit/short-circuit abnormality of the label resistor 109.

Moreover, as a sixth feature of the third embodiment (corresponding to claim 11), the nonvolatile program memory 121C is further provided with a control program which constitutes a regular abnormality determination unit (step 815, 915) and an abnormality notification unit (step 817, 917).

The regular abnormality determination unit (steps 815, 915) is periodically executed during the operation of the microprocessor 120C in which the closed state of the power switch 102 continues, and determines the presence or absence of a short-circuit/open-circuit abnormality of the label resistor 109 or the wiring thereof according to whether the resistance value Rx of the label resistor 109 is less than a predetermined lower limit value, or whether the resistance value Rx of the label resistor 109 is equal to or more than a predetermined upper limit value.

The abnormality notification unit (steps 817, 917) generates an abnormality notification command signal when the regular abnormality determination unit (steps 815, 915) determines an abnormal state. The abnormality notification unit saves and stores abnormality notification historical information into the nonvolatile data memory 123 immediately after the power switch 102 is interrupted.

In addition, as a seventh feature of the third embodiment (corresponding to claim 12), when the order of the theoretical value of the label resistor 109 is changed, a measured potential (divided voltage Vb3) at a junction between the label resistor 109 and the fixed resistor 119*c* input to the microprocessor 120C through the multichannel AD converter 124 becomes a series that changes as a geometric series with a predetermined ratio, and the actual resistance value of the label resistor 109 is selected from a preferred number series based on public standards.

As a result, when the actual order i of the label resistor 109 is changed, the measured potential changes at a ratio larger than the geometric series with the predetermined ratio.

Moreover, as an eighth feature of the third embodiment (corresponding to claim 13), the nonvolatile program memory 121C is further provided with a control program that constitutes an air fuel ratio calibration detection unit (steps 819, 919).

The air fuel ratio calibration detection unit (steps 819, 919) calculates a calibration detection signal output Ipp (=K×Ip) by multiplying a detection signal output Ip corresponding to the air fuel ratio (NF) obtained by the exhaust gas sensor 105C by the correction factor K based on the order i of the label resistor 109 specified by the label resistor discrimination unit (steps 804, 904, 924), and calculates and estimates the current air fuel ratio from the data table (or approximation equation) for the standard output characteristic 200 of the exhaust gas sensor 105C.

Further, as a ninth feature of the third embodiment (corresponding to claim 14), the detection signal output Ip obtained by the exhaust gas sensor 105C is a positive or negative current value, and a circuit for adding a current detection resistance Rs and a bias voltage Vg to each other is added to a circuit that generates the detection signal output Ip, so that a corrected input signal voltage Vin (=Ip×Rs+Vg), being always a positive value, is input to the multichannel AD converter 124.

The microprocessor 120C obtains a digital conversion value proportional to the detection signal output Ip by subtracting a digital conversion value corresponding to the bias voltage Vg from a digital conversion value of the corrected input signal voltage Vin, and dividing it by the value of the current detection resistance Rs.

While the invention has been described in terms of preferred embodiments, those skilled in the art will recognize that the invention can be practiced with modifications within the spirit and scope of the appended claims.

What is claimed is:

1. A vehicle-mounted engine control apparatus which is fed with electric power from an on-vehicle battery through a first power wire thereby to control a group of engine driving electric loads including a fuel injection electromagnetic valve when a power switch is turned on in response to an operating state of an exhaust gas sensor for measuring an air fuel ratio and an operating state of a group of sensors including at least an intake air amount sensor to measure or estimate an amount of intake air for monitoring an operating state of a vehicle-mounted engine, wherein said exhaust gas sensor comprises a label resistor that becomes an index for selecting a correction factor for characteristic variation of an air fuel ratio measurement element, and an electric heater to raise the temperature of said exhaust gas sensor to an activation temperature at an early time;

a positive terminal, to which one end of said label resistor and one end of said electric heater are connected, is connected to said on-vehicle battery through a second power wire;

a negative end of said label resistor and a negative end of said electric heater are connected to said vehicle-mounted engine control apparatus through individual wires, respectively;

as the resistance value of said label resistor, there is selected and used, from among a series of numerical values, one which lies in a predetermined error range around one of said series of numerical values changing in multiple stages;

said vehicle-mounted engine control apparatus includes a microprocessor, a nonvolatile program memory, a RAM memory, a nonvolatile data memory, and a multichannel AD converter, all of which cooperate with one another, and further includes a positive end potential measurement circuit for said label resistor, and a negative end potential measurement circuit that measures a voltage across opposite ends of a given fixed resistor connected in series to an negative end of said label resistor;

said nonvolatile program memory further includes a control program that constitutes a label resistor discrimination unit, a data table or approximation equation for a standard characteristic of a detection signal output versus air fuel ratio of said exhaust gas sensor, and a data table or a conversion data in the form of an approximation equation for the value of a correction factor K corresponding to the discriminated label resistor;

said positive end potential measurement circuit is composed of voltage dividing resistors that divide a first voltage fed from said first power wire or a second voltage fed from said second power wire, and input it to said multichannel AD converter;

said positive end potential measurement circuit is a circuit that serves to input the voltage across the opposite ends of said fixed resistor to said multichannel AD converter;

said label resistor discrimination unit specifies the label resistor of which order stored as said conversion data the resistance value of said label resistor calculated by said microprocessor is; and said microprocessor controls an amount of injection fuel so as to obtain a predetermined air fuel ratio in response to the value of a detection signal output of said exhaust gas sensor, the resistance value of said label resistor, and the value of said conversion data.

2. The vehicle-mounted engine control apparatus as set forth in claim 1, wherein said positive end potential measurement circuit divides said first power feed voltage applied to said vehicle-mounted engine control apparatus through said first power wire, and input it to the multichannel AD converter as a voltage corresponding to said second power feed voltage applied to a positive terminal of said label resistor through said second power wire; and at a point in time immediately after said power switch is turned on, or at least at a point in time at which the power feed to all or part of said group of electric loads including at least said electric heater is not performed in a period in which the power feed to said vehicle-mounted engine control apparatus is continued for a short time after said power switch is interrupted, said label resistor discrimination unit discriminates the resistance value of the label resistor.

3. The vehicle-mounted engine control apparatus as set forth in claim 2, wherein electric power is fed to said vehicle-mounted engine control apparatus and said exhaust gas sensor through an output contact of a first power supply relay that is energized when said power switch is closed; and a common power wire is used as a power wire extending said on-vehicle battery to the output contact of said first power supply relay.

4. The vehicle-mounted engine control apparatus as set forth in claim 1, wherein said positive end potential measurement circuit is composed of voltage dividing resistors of high resistivity that divides said second power feed voltage applied to the positive terminal of said label resistor through said second power wire thereby to input it to said multichannel AD converter;

said negative end potential measurement circuit is composed of a selective switching element that, in response to a selection command signal of said microprocessor, makes a connection of said fixed resistor, and opens a downstream side of said voltage dividing resistors thereby to input the voltage across the opposite ends of said fixed resistor to the same channel of said multichannel AD converter; and said label resistor discrimination unit is provided with a positive terminal potential measurement unit that measures the positive end potential of said label resistor with said fixed resistor being not connected thereto, and a negative terminal potential measurement unit that measures the voltage across the opposite ends of said fixed resistor after said fixed resistor is connected.

5. The vehicle-mounted engine control apparatus as set forth in claim 4 wherein said label resistor discrimination unit is further provided with a positive terminal potential verification unit; and said positive terminal potential verification unit verifies whether positive terminal potentials measured by said positive terminal potential verification unit and by said positive terminal potential verification unit before and after the measurement of the negative terminal potential of said label resistor by said negative terminal potential measurement unit coincide with each other within a predetermined error tolerance.

6. A vehicle-mounted engine control apparatus which is fed with electric power from an on-vehicle battery through a first power wire thereby to control a group of engine driving electric loads including a fuel injection electromagnetic valve when a power switch is turned on in response to an operating state of an exhaust gas sensor for measuring an air fuel ratio and an operating state of a group of sensors including at least an intake air amount sensor to measure or estimate an amount of intake air for monitoring an operating state of a vehicle-mounted engine, wherein said exhaust gas sensor comprises a label resistor that becomes an index for selecting a correction factor for characteristic variation of an air fuel ratio measurement element, and an electric heater to raise the temperature of said exhaust gas sensor to an activation temperature at an early time;

said electric heater has a positive terminal connected to said on-vehicle battery through a second power wire;

said electric heater has a negative terminal connected to said vehicle-mounted engine control apparatus through heater wiring;

said label resistor has a negative terminal connected to the negative terminal of said electric heater;

said label resistor has a positive terminal connected to said vehicle-mounted engine control apparatus through individual wires;

as the resistance value of said label resistor, there is selected and used, from among a series of numerical values, one which lies in a predetermined error range around one of said series of numerical values changing in multiple stages;

said vehicle-mounted engine control apparatus includes a microprocessor, a nonvolatile program memory, a RAM memory, a nonvolatile data memory, and a multichannel AD converter, all of which cooperate with one another, and further includes a fixed resistor of a given resistance value which is connected in series to the positive terminal of said label resistor and to which a drive voltage is applied, a divided voltage measurement circuit that inputs a potential at a junction between said label resistor and said fixed resistor to said multichannel AD converter, and a switching element that connects the negative terminal of said electric heater to a ground circuit thereby to feed electric power to said electric heater in response to a switching command signal from said microprocessor;

said nonvolatile program memory further includes a control program that constitutes a label resistor discrimination unit, a data table or an approximation equation for a standard characteristic of a detection signal output versus air fuel ratio of said exhaust gas sensor, and a data table or a conversion data in the form of an approximation equation for the value of a correction factor K corresponding to the discriminated label resistor;

when said switching element is forcedly closed to cause the logic level of the negative terminal of said label resistor to become a low voltage level, said label resistor discrimination unit calculates the resistance value of said label resistor from the value of the divided voltage input to said multichannel AD converter and the value of said drive voltage applied to said given fixed resistor, and specifies the label resistor of which order stored as said conversion data the resistance value of said label resistor thus calculated is; and said microprocessor controls an amount of injection fuel so as to obtain a predetermined air fuel ratio in response to the value of a detection signal output of said exhaust gas sensor, the resistance value of said label resistor, and the value of said conversion data.

7. The vehicle-mounted engine control apparatus as set forth in claim 6, wherein an output voltage of said switching element is input to said multichannel AD converter through voltage dividing resistors;

a voltage level at the time when said switching element is forcedly closed to cause the logic level of the negative terminal of said label resistor to become a low voltage level is measured by a closing divided voltage of said voltage dividing resistors;

said label resistor discrimination unit calculates a closing voltage of said switching element calculated from said closing divided voltage of said voltage dividing resistors, subtracts a voltage proportional to the closing voltage of said switching element from the value of the divided voltage due to said fixed resistor and said label resistor, calculates the resistance value of said label resistor is calculated from the value of the drive voltage applied to said given fixed resistor, and specifies the label resistor of which order stored as said conversion data the resistance value of said label resistor thus calculated is.

8. The vehicle-mounted engine control apparatus as set forth in claim 6, wherein electric power is fed from said on-board battery to said exhaust gas sensor through an output contact of a second power supply relay; and said label resistor discrimination unit is executed with said second power supply relay being deenergized.

9. The control apparatus for an internal combustion engine as set forth in claim 1 or 6, wherein said nonvolatile program memory further includes a control program that constitutes a determination saving and storing unit and a save verification unit;

said determination saving and storing unit discriminates the label resistor by means of said label resistor discrimination unit in a predetermined period in which the power feed to said vehicle-mounted engine control apparatus is continued for a short time after said power switch is opened, and saves and stores a reference value of said label resistor thus discriminated, or the order of said reference value, or the value of the correction factor corresponding to said reference value, into said nonvolatile data memory; and said save verification unit is executed, immediately after said power switch is closed, to determine whether the discrimination result of said label resistor has already been saved in said nonvolatile data memory by means of said determination saving and storing unit, and if verified and saved, to read out said discrimination result stored in said nonvolatile data memory and to save it in said RAM memory, whereas if the discrimination result is not stored in said nonvolatile data memory, said label resistor discrimination unit is executed so that the current discrimination result is written and saved into said RAM memory.

10. The vehicle-mounted engine control apparatus as set forth in claim 1 or 6, wherein said nonvolatile program memory includes a control program that constitutes a label resistor abnormality determination unit, a tentative information selection unit, and an abnormality occurrence information storage unit;

when the resistance value of said label resistor measured by said label resistor discrimination unit is a value that deviates from a predetermined reference value, said label resistor abnormality determination unit makes a determination that said label resistor is in an open-circuit/short-circuit abnormality;

when the open-circuit/short-circuit abnormality of said label resistor is determined by said label resistor abnormality determination unit, said tentative information selection unit is executed to select a reference factor that adjusts the correction factor K to a value of 1.0 or to continuously use a correction factor in case where there exists the correction factor that has already been selected; and said abnormality occurrence information storage unit transfers to and writes into said nonvolatile data memory the fact that said label resistor abnormality determination unit has determined the open-circuit/short-circuit abnormality of said label resistor.

11. The vehicle-mounted engine control apparatus as set forth in claim 1 or 6, wherein said nonvolatile program memory includes a control program that constitutes a regular abnormality determination unit and an abnormality notification unit;

said regular abnormality determination unit is periodically executed during the operation of said microprocessor in which the closed state of said power switch continues, and determines the presence or absence of a short-circuit/open-circuit abnormality of said label resistor or the wiring thereof in response to whether the resistance value of said label resistor is less than a predetermined lower limit value, or whether the resistance value of said label resistor is equal to or more than a predetermined upper limit value; and said abnormality notification unit generates an abnormality notification command signal when said regular abnormality determination unit executes abnormality determination processing, and saves and stores abnormality notification historical information into said nonvolatile data memory immediately after said power switch 102 is interrupted.

12. The vehicle-mounted engine control apparatus as set forth in claim 1 or 6, wherein when the order of the theoretical value of said label resistor is changed, a measured potential at the junction between said label resistor and said fixed resistor input to said microprocessor through said multichannel AD converter becomes a series that changes as a geometric series with a predetermined ratio;

an actual resistance value of said label resistor is selected from a standard numerical series based on public standards; and as a result, when the actual order of said label resistor is changed, the measured potential changes at a ratio larger than said geometric series with the predetermined ratio.

13. The vehicle-mounted engine control apparatus as set forth in claim 1 or 6, wherein said nonvolatile program memory further includes a control program that constitutes an air fuel ratio calibration detection unit;

said air fuel ratio calibration detection unit calculates a calibration detection signal output by multiplying a detection signal output corresponding to the air fuel ratio obtained by said exhaust gas sensor by a correction factor based on the order of said label resistor specified by said label resistor discrimination unit, calculates and estimates a current air fuel ratio from data table or an approximation equation for the standard output characteristic of said exhaust gas sensor.

14. The vehicle-mounted engine control apparatus as set forth in claim 13, wherein the detection signal output obtained by said exhaust gas sensor is a positive or negative current value;

a circuit for adding a current detection resistance and a bias voltage to each other is added to a circuit that generates said detection signal output, so that a corrected input signal voltage, being always a positive value, is input to said multichannel AD converter; and said microprocessor obtains a digital conversion value proportional to said detection signal output by subtracting a digital conversion value corresponding to said bias voltage from a digital conversion value of said corrected input signal voltage, and dividing it by the value of said current detection resistance.

* * * * *